US011303038B2

(12) United States Patent
Lee et al.

(10) Patent No.: US 11,303,038 B2
(45) Date of Patent: Apr. 12, 2022

(54) ANTENNA APPARATUS

(71) Applicant: Samsung Electro-Mechanics Co., Ltd., Suwon-si (KR)

(72) Inventors: Won Cheol Lee, Suwon-si (KR); Jeong Ki Ryoo, Suwon-si (KR); Nam Ki Kim, Suwon-si (KR); Myeong Woo Han, Suwon-si (KR); Sang Hyun Kim, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 65 days.

(21) Appl. No.: 16/738,375

(22) Filed: Jan. 9, 2020

(65) Prior Publication Data

US 2021/0044028 A1 Feb. 11, 2021

(30) Foreign Application Priority Data

Aug. 8, 2019 (KR) ..... 10-2019-0096690

(51) Int. Cl.

| | |
|---|---|
| ***H01Q 1/38*** | (2006.01) |
| ***H01Q 21/06*** | (2006.01) |
| ***H01Q 9/04*** | (2006.01) |
| ***H01Q 5/42*** | (2015.01) |
| ***H01Q 21/24*** | (2006.01) |

(52) U.S. Cl.

CPC ..... *H01Q 21/061* (2013.01); *H01Q 5/42* (2015.01); *H01Q 9/045* (2013.01); *H01Q 21/24* (2013.01)

(58) Field of Classification Search

CPC ..... H01Q 21/061; H01Q 9/045; H01Q 5/42; H01Q 21/24

See application file for complete search history.

(56) References Cited

U.S. PATENT DOCUMENTS

| | | | | |
|---|---|---|---|---|
| 8,405,564 | B2 | 3/2013 | Kindt et al. | |
| 9,368,873 | B2 | 6/2016 | Myszne et al. | |
| 2015/0333407 | A1* | 11/2015 | Yamagajo | H01Q 5/40 343/905 |
| 2018/0159203 | A1* | 6/2018 | Baks | H01Q 1/2283 |
| 2019/0020110 | A1* | 1/2019 | Paulotto | H01Q 19/005 |
| 2019/0020121 | A1* | 1/2019 | Paulotto | H01Q 21/065 |
| 2020/0106158 | A1* | 4/2020 | Gomez Angulo | G06F 1/1698 |

FOREIGN PATENT DOCUMENTS

| | | |
|---|---|---|
| JP | 6379303 B2 | 8/2018 |
| KR | 10-1164618 B1 | 7/2012 |
| KR | 10-1798628 B1 | 11/2017 |
| WO | WO 2016/137757 A1 | 9/2016 |

* cited by examiner

*Primary Examiner* — Dieu Hien T Duong
(74) *Attorney, Agent, or Firm* — NSIP Law

(57) ABSTRACT

An antenna apparatus includes a ground plane, a plurality of first patch antenna patterns arranged on a level higher than the ground plane and each configured to transmit and/or receive a first radio frequency signal of a first frequency, a plurality of second patch antenna patterns arranged on a level higher than the ground plane and each having a size smaller than a size of each of the first patch antenna patterns, wherein the plurality of second patch antenna patterns include at least one feed patch antenna pattern configured to transmit and/or receive a second radio frequency signal of a second frequency different from the first frequency, and at least one dummy patch antenna pattern which is not fed any of the first and second radio frequency signals.

21 Claims, 27 Drawing Sheets

ANTENNA APPARATUS

CROSS-REFERENCE TO RELATED APPLICATIONS

This application claims the benefit under 35 U.S.C. 119(a) of Korean Patent Application No. 10-2019-0096690 filed on Aug. 8, 2019, in the Korean Intellectual Property Office, the entire disclosure of which is incorporated herein by reference for all purposes.

BACKGROUND

1. Field

The present disclosure relates to an antenna apparatus.

2. Description of the Background

Mobile communications data traffic has increased on an annual basis. Various techniques have been developed to support the rapid increase in data in wireless networks in real time. For example, conversion of Internet of Things (IoT)-based data into contents, augmented reality (AR), virtual reality (VR), live VR/AR linked with SNS, an automatic driving function, applications such as a sync view (transmission of real-time images from a user's viewpoint using a compact camera), and the like, may require communications (e.g., 5G communications, mmWave communications, and the like) which support the transmission and reception of large volumes of data.

Accordingly, there has been a large amount of research on mmWave communications including 5th generation (5G), and the research into the commercialization and standardization of an antenna apparatus for implementing such communications has been increasingly conducted.

An RF signal of a high frequency band (e.g., 24 GHz, 28 GHz, 36 GHz, 39 GHz, 60 GHz, and the like) may easily be absorbed and lost during transmissions, which may degrade quality of communications. Thus, an antenna for communications performed in a high frequency band may require a technical approach different from techniques used in a general antenna, and a special technique such as a separate power amplifier, and the like, may be required to secure antenna gain, integration of an antenna and a radio frequency integrated circuit (RFIC), effective isotropic radiated power (EIRP), and the like.

The above information is presented as background information only to assist with an understanding of the present disclosure. No determination has been made, and no assertion is made, as to whether any of the above might be applicable as prior art with regard to the disclosure.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna apparatus includes a ground plane, a plurality of first patch antenna patterns arranged on a level higher than the ground plane and each configured to transmit and/or receive a first radio frequency signal of a first frequency, a plurality of second patch antenna patterns arranged on a level higher than the ground plane and each having a size smaller than a size of each of the plurality of first patch antenna patterns, wherein the plurality of second patch antenna patterns include at least one feed patch antenna pattern configured to transmit and/or receive a second radio frequency signal of a second frequency different from the first frequency, and at least one dummy patch antenna pattern which is not fed any of the first and second radio frequency signals.

The plurality of second patch antenna patterns may be disposed on a level higher than the plurality of first patch antenna patterns.

The antenna apparatus may further include a plurality of third patch antenna patterns disposed on a level higher than the ground plane, overlapping the plurality of first patch antenna patterns, and each configured to transmit and/or receive a third radio frequency signal of a third frequency different from the first and second frequencies.

The plurality of third patch antenna patterns may each have a size less than a size of each of the plurality of first patch antenna patterns and greater than a size of each of the plurality of second patch antenna patterns.

The plurality of third patch antenna patterns may be disposed on a level higher than the plurality of first patch antenna patterns and lower than the plurality of second patch antenna patterns.

Portions of the plurality of second patch antenna patterns may overlap the plurality of first patch antenna patterns, and other portions of the plurality of second patch antenna patterns may not overlap the plurality of first patch antenna patterns.

The plurality of first patch antenna patterns may be spaced apart from each other by a first spacing distance and arranged in a first direction, and the plurality of second patch antenna patterns may be spaced apart from each other by a second spacing distance shorter than the first spacing distance and arranged in the first direction.

Portions of the plurality of second patch antenna patterns may be arranged in a first direction, and the portions of the plurality of second patch antenna patterns may be disposed such that each of the plurality of first patch antenna patterns is disposed in a region between the portions of the plurality of second patch antenna patterns taken in a second direction.

Other portions of the plurality of second patch antenna patterns may be disposed such that each of the plurality of first patch antenna patterns is disposed in a region between the other portions of the plurality of second patch antenna patterns taken in the first direction.

Portions of the plurality of second patch antenna patterns may be disposed to surround each of a plurality of regions between adjacent ones of the plurality of first patch antenna patterns.

The portions and additional portions of the plurality of second patch antenna patterns may be disposed to surround each of the plurality of first patch antenna patterns and each of the plurality of regions, and some of the portions of the plurality of second patch antenna patterns both surround each of the plurality of regions with a remainder of the portions and surround each of the plurality of first patch antenna patterns with the additional portions.

At least one of the plurality of second patch antenna patterns may include at least one slit portion formed from one side to the other side, and may overlap a corresponding first patch antenna pattern of the plurality of first patch antenna patterns.

At least one of the plurality of second patch antenna patterns may overlap a corresponding first patch antenna pattern of the plurality of first patch antenna patterns, and the at least one of the plurality of second patch antenna patterns may extend in a plurality of directions from one point overlapping the corresponding first patch antenna pattern.

The antenna apparatus may further include a plurality of second feed vias providing a feed path for at least one feed patch antenna pattern of the plurality of second patch antenna patterns and penetrating the ground plane.

The antenna apparatus may further include a plurality of first feed vias providing a feed path for a corresponding first patch antenna pattern of the plurality of first patch antenna patterns and penetrating the ground plane.

At least one of the plurality of second feed vias may provide a feed path for a corresponding first patch antenna pattern of the plurality of first patch antenna patterns.

In another general aspect, an antenna apparatus includes a ground plane, a plurality of first patch antenna patterns arranged on a level higher than the ground plane and fed with power, and a plurality of second patch antenna patterns each having a size smaller than a size of each of the plurality of first patch antenna patterns, and arranged on a level higher than the ground plane, wherein the plurality of second patch antenna patterns are arranged to surround each of the plurality of first patch antenna patterns and each of a plurality of regions between adjacent ones of the plurality of first patch antenna patterns, and wherein a portion of the plurality of second patch antenna patterns partially surrounds both the plurality of regions and the plurality of first patch antenna patterns.

Each second patch antenna pattern of the portion of the plurality of second patch antenna patterns may have a structure in which a length taken in a first direction is longer than a length taken in a second direction, and each second patch antenna pattern of another portion of the plurality of second patch antenna patterns may have a structure in which a length taken in the first direction is shorter than a length taken in a second direction.

The plurality of first patch antenna patterns may be arranged in the first direction, and a length of each of the plurality of regions surrounded by the portions of the plurality of second patch antenna patterns taken in the second direction may be longer than a length of each of the plurality of regions taken in the first direction.

The antenna apparatus may further include a plurality of third patch antenna patterns disposed on a level higher than the ground plane, overlapping the plurality of first patch antenna patterns, and fed with power.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
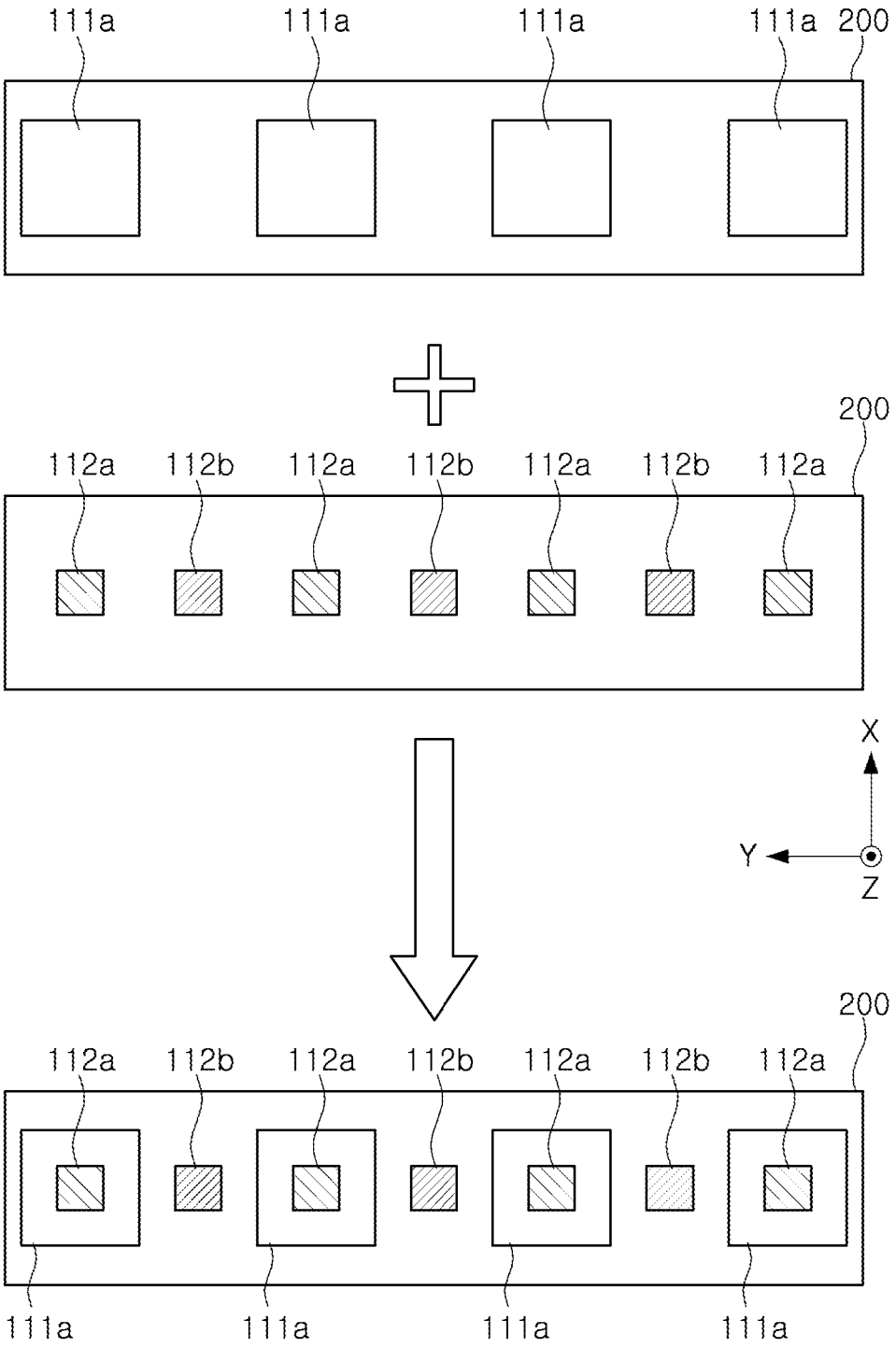
FIG. 1 is a plan view illustrating combination of first and second patch antenna patterns of an antenna apparatus according to an example embodiment of the present disclosure.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of this disclosure. For example, the sequences of operations described herein are merely examples, and are not limited to those set forth herein, but may be changed as will be apparent after an understanding of this disclosure, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of this disclosure. Hereinafter, while embodiments of the present disclosure will be described in detail with reference to the accompanying drawings, it is noted that examples are not limited to the same.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween. As used herein "portion" of an element may include the whole element or less than the whole element.

As used herein, the term "and/or" includes any one and any combination of any two or more of the associated listed items; likewise, "at least one of" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of this disclosure. Further, although the examples described herein have a variety of configurations, other configurations are possible as will be apparent after an understanding of this disclosure.

Herein, it is noted that use of the term "may" with respect to an example, for example, as to what an example may include or implement, means that at least one example exists in which such a feature is included or implemented while all examples are not limited thereto.

An aspect of the present disclosure is to provide an antenna apparatus which may improve antenna performance (e.g., gain, bandwidth, directivity, etc.), may provide a plurality of communications corresponding to a plurality of different bands, respectively, in an efficient manner, and/or may be easily miniaturized.

Figure 2A:
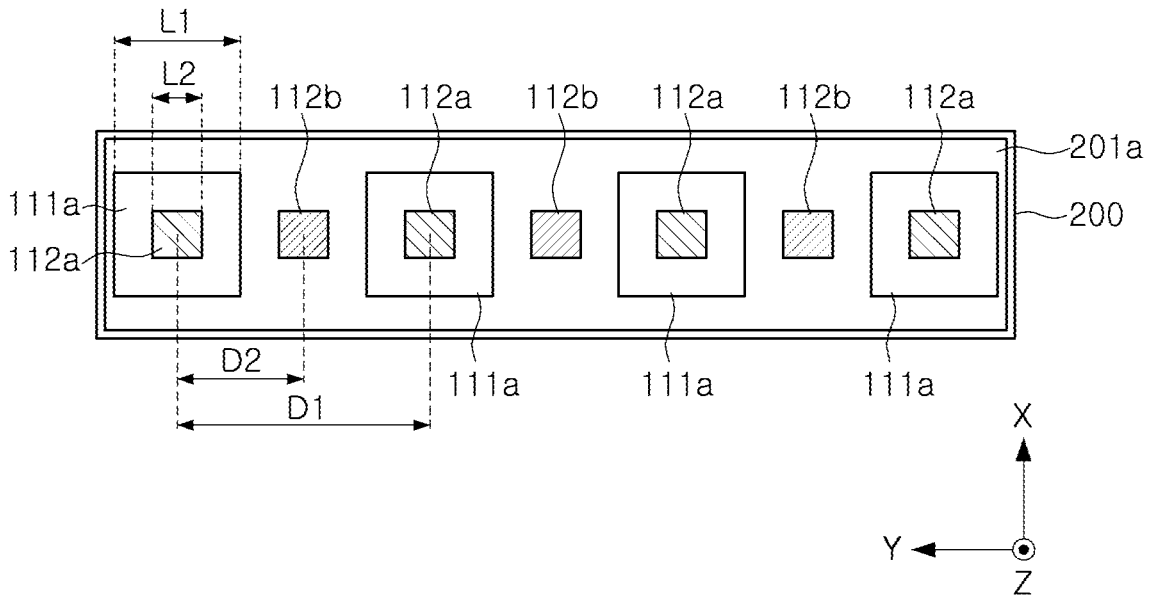
FIG. 2A is a plan view illustrating an antenna apparatus according to an example embodiment of the present disclosure.

FIG. 1 is a plan view illustrating combination of first and second patch antenna patterns of an antenna apparatus according to an example embodiment. FIG. 2A is a plan view illustrating an antenna apparatus according to an example embodiment.

Referring to FIGS. 1 and 2A, an antenna apparatus in the example embodiment may include a ground plane 201*a*, a plurality of first patch antenna patterns 111*a*, and a plurality of second patch antenna patterns 112*a* and 112*b*.

The ground plane 201*a* may be included in a connection member 200. For example, the connection member 200 may have a structure in which a plurality of wiring layers are alternately layered with a plurality of insulating layers as in a printed circuit board (PCB), and the ground plane 201*a* may be included in at least one of the plurality of wiring layers.

The ground plane 201*a* may be disposed downwardly of the plurality of first and second patch antenna patterns 111*a*, 112*a*, and 112*b* and may be spaced apart from the first and second patch antenna patterns 111*a*, 112*a*, and 112*b*. The ground plane 201*a* may have an upper surface configured to have a predetermined width such that the ground plane 201*a* may overlap the first and second patch antenna patterns 111*a*, 112*a*, and 112*b* in upward and downward directions (e.g., a z direction).

The upper surface of the ground plane 201*a* may work as an electromagnetic reflector with respect to the plurality of first and second patch antenna patterns 111*a*, 112*a*, and 112*b*. For example, first and second radio frequency (RF) signals radiated to a lower side from the plurality of first and second patch antenna patterns 111*a*, 112*a*, and 112*b* may be reflected to an upper side from the ground plane 201*a*. The first and second RF signals reflected from the ground plane 201*a* may overlap the first and second radio frequency signals radiated to an upper side from the plurality of first and second patch antenna patterns 111*a*, 112*a*, and 112*b*. Accordingly, a transmission and reception direction of the first and second radio frequency signals may be focused on an upper side by the plurality of first and second patch antenna patterns 111*a*, 112*a*, and 112*b*.

The ground plane 201*a* may electromagnetically shield a region between the structure of the connection member 200 disposed on a level lower than the ground plane 201*a* and the plurality of first and second patch antenna patterns 111*a*, 112*a*, and 112*b*, thereby reducing electromagnetic interference between the connection member 200 and the plurality of first and second patch antenna patterns 111*a*, 112*a*, and 112*b*.

The plurality of first patch antenna patterns 111*a* may be arranged on a level higher than the ground plane 201*a*, and each of the plurality of first patch antenna patterns 111*a* may be configured to transmit and/or receive a first RF signal of a first frequency (e.g., 28 GHz, 39 GHz or the like) from/to an integrated circuit (IC), and may remotely transmit and/or receive the first RF signal in a z direction.

Radiation patterns of the plurality of first patch antenna patterns 111*a* may overlap with one another. Thus, the higher the number of the plurality of first patch antenna patterns 111*a*, the higher the gains of the plurality of first patch antenna patterns 111*a*.

The overlapping of the radiation patterns of the plurality of first patch antenna patterns 111*a* may improve gains of the plurality of first patch antenna patterns 111*a* by constructive interference, and may deteriorate the gains by destructive interference.

Accordingly, the higher the ratio of constructive interference to destructive interference in the overlapping of the radiation patterns of the plurality of first patch antenna patterns 111*a*, the higher the gains of the plurality of first patch antenna patterns 111*a*. The ratio may be affected by a first spacing distance D1 between the plurality of first patch antenna patterns 111*a*. For example, the first spacing distance D1 may be configured to be a half of a first wavelength of the first RF signal, but an example embodiment thereof is not limited thereto.

The plurality of second patch antenna patterns 112*a* and 112*b* may be arranged on a level higher than the ground plane 201*a*, and at least portions of the plurality of second patch antenna patterns 112*a* and 112*b* may be configured to transmit and/or receive a second RF signal of a second frequency (e.g., 60 GHz, 77 GHz, or the like) different from the first frequency from/to the IC and may remotely transmit and/or receive the second RF signal in the z direction.

A first length L1 of each of the plurality of first patch antenna patterns 111*a* may correspond to a first wavelength of the first RF signal, and a second length L2 of each of the plurality of second patch antenna patterns 112*a* and 112*b* may correspond to a second wavelength of the second RF signal.

The second length L2 of each of the plurality of second patch antenna patterns 112*a* and 112*b* may be less than the first length L1 of each of the plurality of first patch antenna patterns 111*a*.

Accordingly, the plurality of first patch antenna patterns 111*a* may remotely transmit and receive the first RF signal having a relatively long first wavelength, and at least portions of the plurality of second patch antenna patterns 112*a* and 112*b* may remotely transmit and receive the second RF signal having a relatively short second wavelength.

Radiation patterns of at least portions of the plurality of second patch antenna patterns 112*a* and 112*b* may overlap with one another. Accordingly, the higher the number of the plurality of second patch antenna patterns 112*a* and 112*b*, the higher the gains of the plurality of second patch antenna patterns 112*a* and 112*b*.

The overlapping of the radiation patterns of the at least portions of the plurality of second patch antenna patterns 112*a* and 112*b* may improve gains of the plurality of second patch antenna patterns 112*a* and 112*b* by constructive interference, and may deteriorate the gains by destructive interference.

Accordingly, the higher the ratio of constructive interference to destructive interference in the overlapping of the radiation patterns of the at least portions of the plurality of second patch antenna patterns 112*a* and 112*b*, the higher the gains of the plurality of second patch antenna patterns 112*a* and 112*b*. The ratio may be affected by a second spacing distance D2 between the plurality of second patch antenna patterns 112*a* and 112*b*. For example, the second spacing distance D2 may be configured to be a half of a second wavelength of the second RF signal, but an example embodiment thereof is not limited thereto.

As the second wavelength of the second RF signal is shorter than the first wavelength of the first RF signal, the second spacing distance D2 may be shorter than the first spacing distance D1. Accordingly, the number of the plurality of second patch antenna patterns 112*a* and 112*b* per unit area of the ground plane 201*a* may be higher than the number of the plurality of first patch antenna patterns 111*a* in the same unit area.

For example, when the first spacing distance D1 is twice the second spacing distance D2, half portions of the plurality of second patch antenna patterns 112*a* and 112*b* may be disposed relatively adjacent to the plurality of first patch antenna patterns 111*a*, and the other portions may be disposed relatively further from the plurality of first patch antenna patterns 111*a*.

A first electromagnetic boundary condition of the second patch antenna patterns of the plurality of second patch antenna patterns 112*a* and 112*b* disposed relatively adjacent to the plurality of first patch antenna patterns 111*a* may be different from a second electromagnetic boundary condition of the second patch antenna patterns disposed relatively further from the plurality of first patch antenna patterns 111*a*.

A difference between the first electromagnetic boundary condition and the second electromagnetic boundary condition may distort the overlapping of radiation patterns of at least portions of the plurality of second patch antenna patterns 112*a* and 112*b*, which may adversely affect the improvement of gains of the plurality of second patch antenna patterns 112*a* and 112*b*.

Thus, the plurality of second patch antenna patterns 112*a* and 112*b* of the antenna apparatus in the example embodiment may include at least one feed patch antenna pattern 112*a* and at least one dummy patch antenna pattern 112*b*.

The at least one feed patch antenna pattern 112*a* may be configured to transmit and/or receive a second RF signal of a second frequency (e.g., 60 GHz, 77 GHz, or the like) different from the first frequency from/to the IC, and may remotely transmit and/or receive the second RF signal in the z direction.

The at least one dummy patch antenna pattern 112*b* may be configured to not be fed the first and/or second RF signals.

If one of the plurality of second patch antenna patterns 112*a* and 112*b* is changed to the dummy patch antenna pattern 112*b* while all of the plurality of second patch antenna patterns 112*a* and 112*b* are the feed patch antenna patterns 112*a*, a portion of an integrated radiation pattern of the plurality of second patch antenna patterns 112*a* and 112*b* corresponding to the dummy patch antenna pattern 112*b* may be removed.

As an electromagnetic boundary condition of the dummy patch antenna pattern 112*b* of the plurality of second patch antenna patterns 112*a* and 112*b* is different from an electromagnetic boundary condition of the other patch antenna patterns, a degree of distortion of the integrated radiation pattern of the plurality of second patch antenna patterns 112*a* and 112*b* may be reduced as the radiation pattern corresponding to the dummy patch antenna pattern 112*b* is removed, and efficiency of the overlapping of radiation patterns of the plurality of second patch antenna patterns 112*a* and 112*b* may improve as the radiation pattern corresponding to the dummy patch antenna pattern 112*b* is removed.

Accordingly, a gain of when a portion of the plurality of second patch antenna patterns 112*a* and 112*b* is the dummy patch antenna pattern 112*b* may be higher than a gain of when all of the plurality of second patch antenna patterns 112*a* and 112*b* are the feed patch antenna patterns 112*a*.

A combination of the number/position of the dummy patch antenna pattern 112*b* of the plurality of second patch antenna patterns 112*a* and 112*b* may be varied, and the number/position of at least one dummy patch antenna pattern 112*b* of the plurality of second patch antenna patterns 112*a* and 112*b* may correspond to a combination in which gains of the plurality of second patch antenna patterns 112*a* and 112*b* are the highest among a plurality of combinations.

As a second patch antenna pattern of the plurality of second patch antenna patterns 112*a* and 112*b* overlapping the plurality of first patch antenna patterns 111*a* in upward and downward directions (e.g., a z direction) may use the plurality of first patch antenna patterns 111*a* as electromagnetic reflectors, gains of the plurality of second patch antenna patterns 112*a* and 112*b* may improve effectively.

Thus, the second patch antenna pattern of the plurality of second patch antenna patterns 112*a* and 112*b* overlapping the plurality of first patch antenna patterns 111*a* in the upward and downward directions (e.g., a z direction) may be the feed patch antenna pattern 112*a*, and at least a portion of second patch antenna patterns of the plurality of second patch antenna patterns 112*a* and 112*b* which does not overlap the plurality of first patch antenna patterns 111*a* in the upward and downward directions (e.g., a z direction) may be the dummy patch antenna pattern 112*b*. Accordingly, gains of the plurality of second patch antenna patterns 112*a* and 112*b* may improve.

The plurality of second patch antenna patterns 112*a* and 112*b* may be disposed on a level higher than the plurality of first patch antenna patterns 111*a*. Accordingly, the dummy patch antenna pattern 112*b* may also be disposed on a level higher than the plurality of first patch antenna patterns 111*a*, as well as the feed patch antenna pattern 112*a*.

Accordingly, the plurality of second patch antenna patterns 112*a* and 112*b* may use the plurality of first patch antenna patterns 111*a* as electromagnetic reflectors, and a degree of distortion of the integrated radiation pattern of the plurality of second patch antenna patterns 112*a* and 112*b* may be reduced, thereby improving gains.

Figure 2B:
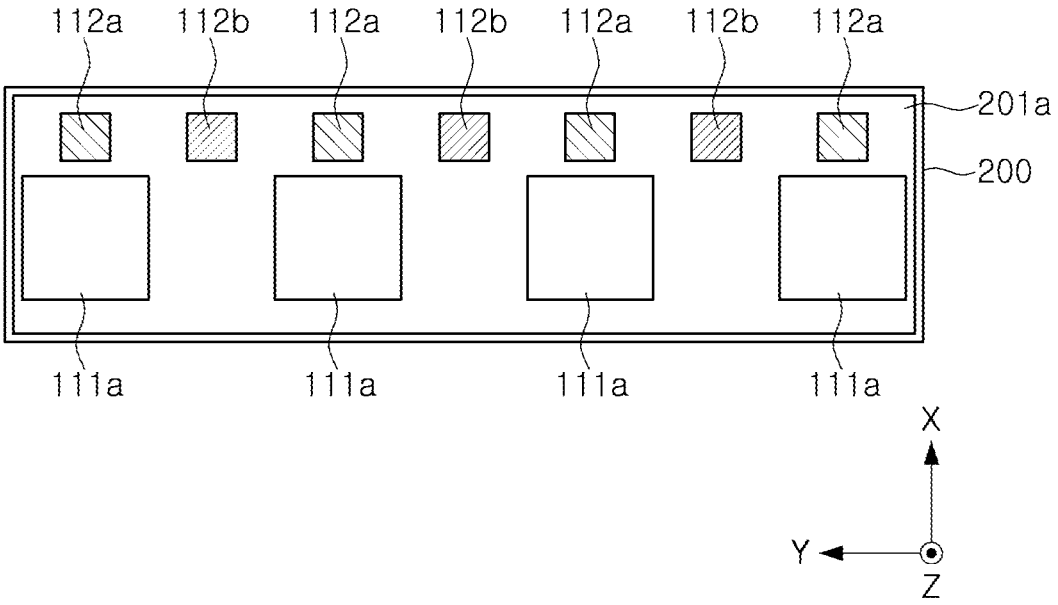
FIG. 2B is a plan view illustrating an arrangement structure in which first and second patch antenna patterns do not overlap each other in an antenna apparatus according to an example embodiment of the present disclosure.

FIG. 2B is a plan view illustrating an arrangement structure in which first and second patch antenna patterns do not overlap each other in an antenna apparatus according to an example embodiment.

Referring to FIG. 2B, the plurality of first patch antenna patterns 111*a* and the plurality of second patch antenna patterns 112*a* and 112*b* may be arranged in a first direction (e.g., a y direction), may be disposed in parallel to each other, and may not overlap with each other in the upward and downward directions (e.g., a z direction).

A first electromagnetic boundary condition of second patch antenna patterns of the plurality of second patch antenna patterns 112*a* and 112*b* disposed relatively adjacent to the plurality of first patch antenna patterns 111*a* may be different from a second electromagnetic boundary condition of second patch antenna patterns disposed relatively further from the first patch antenna patterns 111*a*.

A difference between the first electromagnetic boundary condition and the second electromagnetic boundary condition may distort the overlapping of radiation patterns of at least portions of the plurality of second patch antenna patterns 112*a* and 112*b*, which may adversely affect improvement of gains of the plurality of second patch antenna patterns 112*a* and 112*b*.

As the plurality of second patch antenna patterns 112*a* and 112*b* include at least one dummy patch antenna pattern 112*b*, a degree of distortion of an integrated radiation pattern of the plurality of second patch antenna patterns 112*a* and 112*b* may be reduced, and the plurality of second patch antenna patterns 112*a* and 112*b* may have improved gains.

Figure 2C:
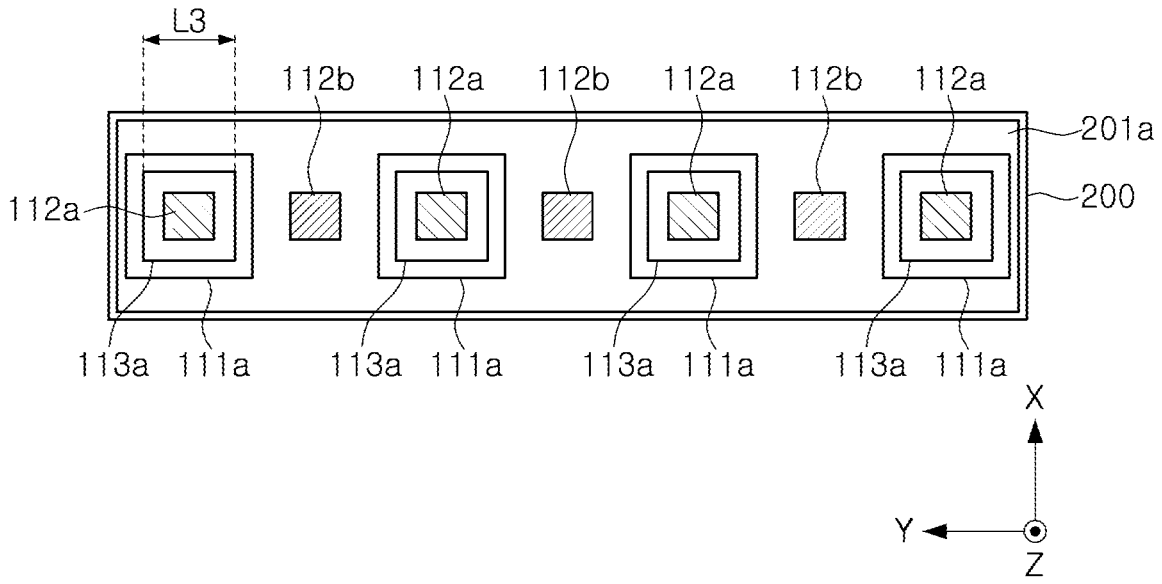
FIG. 2C is a plan view illustrating a structure in which a third patch antenna pattern is further included in an antenna apparatus according to an example embodiment of the present disclosure.

FIG. 2C is a plan view illustrating a structure in which a third patch antenna pattern is further included in an antenna apparatus according to an example embodiment.

Referring to FIG. 2C, the antenna apparatus in the example embodiment may further include a plurality of third patch antenna patterns 113*a*.

The plurality of third patch antenna patterns 113*a* may be disposed on a level higher than the ground plane 201*a*, may overlap the plurality of first patch antenna patterns 111*a* in the upward and downward directions (e.g., a z direction), and may be configured to transmit and/or receive a third RF signal of a third frequency (e.g., 39 GHz) different from the first and second frequencies (e.g., 28 GHz, 60 GHz, or the like).

The plurality of third patch antenna patterns 113*a* may use the plurality of first patch antenna patterns 111*a* as electromagnetic reflectors, and accordingly, a direction in which the third RF signal is remotely transmitted and received may be focused in the z direction.

For example, a third length L3 of each of the plurality of third patch antenna patterns 113*a* may be less than the first length of each of the plurality of first patch antenna patterns 111*a* and may be greater than the second length of each of the plurality of second patch antenna patterns 112*a* and 112*b*.

Accordingly, the plurality of third patch antenna patterns 113*a* may remotely transmit and/or receive the third RF signal corresponding to a frequency higher than a frequency of the first RF signal which the plurality of first patch antenna patterns 111*a* transmit and/or receive and lower than a frequency of the second RF signal which the plurality of second patch antenna patterns 112*a* and 112*b* transmit and/or receive.

A third wavelength of the third RF signal of the plurality of third patch antenna patterns 113*a* may be shorter than the first wavelength of the first RF signal of the plurality of first patch antenna patterns 111*a*. As the plurality of third patch antenna patterns 113*a* overlap the plurality of first patch antenna patterns 111*a*, a third spacing distance between the plurality of third patch antenna patterns 113*a* may be similar to the first spacing distance D1 between the plurality of first patch antenna patterns 111*a*. Accordingly, efficiency of overlapping of radiation patterns of the plurality of third patch antenna patterns 113*a* may be lower than efficiency of overlapping of radiation patterns of the plurality of first patch antenna patterns 111*a*.

The plurality of third patch antenna patterns 113*a* may be disposed on a level higher than the plurality of first patch antenna patterns 111*a* and lower than the plurality of second patch antenna patterns 112*a* and 112*b*.

Accordingly, the plurality of third patch antenna patterns 113*a* may use the plurality of first patch antenna patterns 111*a* as electromagnetic reflectors and may use portions of the plurality of second patch antenna patterns 112*a* and 112*b* as electromagnetic directors, thereby improving efficiency in overlapping of the radiation patterns. Accordingly, the antenna apparatus in the example embodiment may harmoniously improve overall gains with respect to the first, second, and third RF signals.

Figure 2D:
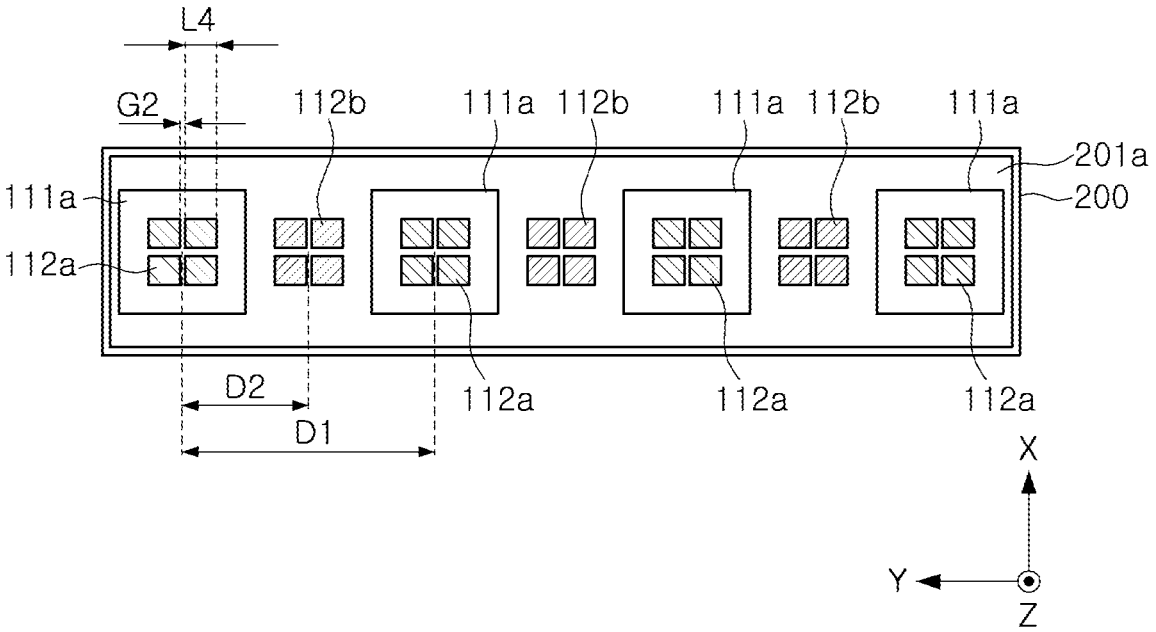
FIG. 2D is a plan view illustrating a structure in which a slit portion is formed in a second patch antenna pattern in an antenna apparatus according to an example embodiment of the present disclosure.

FIG. 2D is a plan view illustrating a structure in which a slit portion is formed in a second patch antenna pattern in an antenna apparatus according to an example embodiment.

Referring to FIG. 2D, at least one of the plurality of second patch antenna patterns 112*a* and 112*b* may include at least one slit portion formed from one side to the other side. The slit portion may have a second width G2.

By including the slit portion having the second width G2, the plurality of first patch antenna patterns 111*a* may form a radiation pattern while circumventing the plurality of second patch antenna patterns 112*a* and 112*b* in an efficient manner. Accordingly, gains of the plurality of first patch antenna patterns 111*a* may improve.

Each of the plurality of second patch antenna patterns 112*a* and 112*b* may be divided into a plurality of portions each having a fourth length L4 shorter than the second length. Accordingly, the plurality of first patch antenna patterns 111*a* may have improved efficiency in reflecting the second RF signal, and may have improved gains.

Figure 2E:
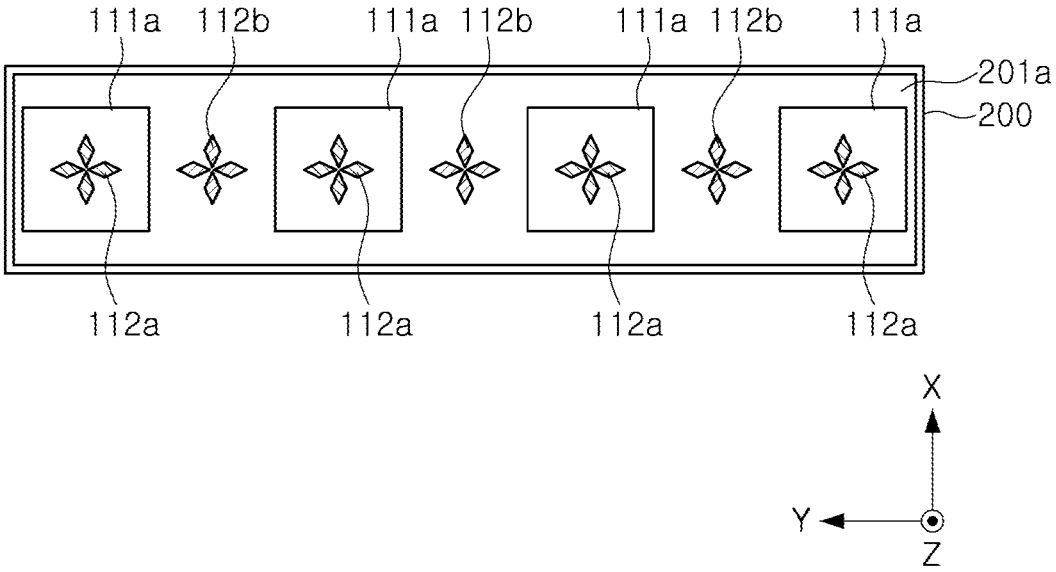
FIG. 2E is a plan view illustrating a structure in which a second patch antenna pattern extends in a plurality of directions in an antenna apparatus according to an example embodiment of the present disclosure.

FIG. 2E is a plan view illustrating a structure in which a second patch antenna pattern extends in a plurality of directions in an antenna apparatus according to an example embodiment.

Referring to FIG. 2E, at least one of the plurality of second patch antenna patterns 112*a* and 112*b* may be configured to extend in a plurality of directions from one point (e.g., a center of a first patch antenna pattern) of a corresponding first patch antenna pattern of the plurality of first patch antenna patterns 111*a*.

Accordingly, the plurality of first patch antenna patterns 111*a* may form a radiation pattern while circumventing the plurality of second patch antenna patterns 112*a* and 112*b* in an efficient manner. Thus, gains of the plurality of first patch antenna patterns 111*a* may improve.

Also, the plurality of second patch antenna patterns 112*a* and 112*b* may be divided into a plurality of portions, and accordingly, the plurality of first patch antenna patterns 111*a* may have improved efficiency in reflecting the second RF signal, and may have improved gains. For example, each of the plurality of portions may have a rhombic shape.

Figure 3A:
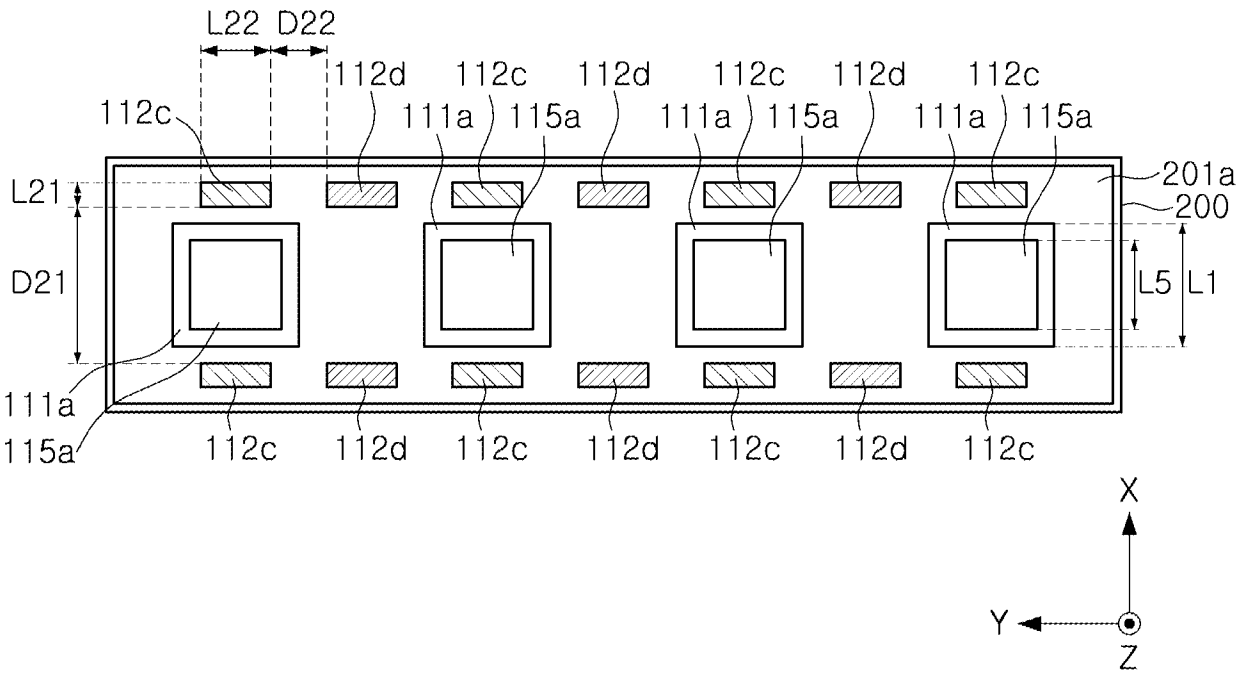
FIG. 3A is a plan view illustrating an arrangement structure in which first and second patch antenna patterns do not overlap each other in an antenna apparatus according to an example embodiment of the present disclosure.

FIG. 3A is a plan view illustrating an arrangement structure in which first and second patch antenna patterns do not overlap each other in the upward and downward directions (e.g., a z direction) in an antenna apparatus according to an example embodiment.

Referring to FIG. 3A, at least portions of plurality of second patch antenna patterns 112*c* and 112*d* may be spaced apart from each other by a 2-2th spacing distance D22 and may be arranged in the first direction (e.g., a y direction), and portions of the plurality of second patch antenna patterns 112*c* and 112*d* may be spaced apart from each other by a 2-1th spacing distance D21 such that each of a plurality of first patch antenna patterns 111*a* may be disposed in a region between the plurality of second patch antenna patterns 112*c* and 112*d* taken in a second direction (e.g., an x direction).

A first electromagnetic boundary condition of the second patch antenna pattern 112*c* of the plurality of second patch antenna patterns 112*c* and 112*d* disposed relatively adjacent to the plurality of first patch antenna patterns 111*a* may be different from a second electromagnetic boundary condition of the second patch antenna pattern 112*d* disposed relatively further from the plurality of first patch antenna patterns 111*a*.

A difference between the first electromagnetic boundary condition and the second electromagnetic boundary condition may distort the overlapping of radiation patterns of at least portions of the plurality of second patch antenna patterns 112*c* and 112*d*, which may adversely affect improvement of gains of the plurality of second patch antenna patterns 112*c* and 112*d*.

The plurality of second patch antenna patterns 112*c* and 112*d* may include at least one dummy patch antenna pattern 112*d*, and accordingly, a degree of distortion of an integrated radiation pattern of the plurality of second patch antenna patterns 112*c* and 112*d* may be reduced, and the plurality of second patch antenna patterns 112*c* and 112*d* may have improved gains.

A length L22 of each of the plurality of second patch antenna patterns 112*c* and 112*d* taken in the first direction may be longer than a length L21 of each of the plurality of second patch antenna patterns 112*c* and 112*d* taken in the second direction. Accordingly, a length of the antenna apparatus taken in the second direction (e.g., an x direction) may be reduced in the example embodiment.

For example, the plurality of second patch antenna patterns 112*c* and 112*d* may have a Planar Inverted-F Antenna (PIFA) structure or a monopole antenna structure, which may be appropriate for the length L22 taken in the first direction and the length L21 taken in the second direction, but an example embodiment thereof is not limited thereto.

The plurality of third patch antenna patterns 115*a* may be disposed on a level higher than the ground plane 201*a*, may overlap the plurality of first patch antenna patterns 111*a* in the upward and downward directions (e.g., a z direction), and may be configured to transmit and/or receive a third RF signal of a third frequency different from the first and second frequencies. Each of the plurality of third patch antenna patterns 115*a* may have a fifth length L5.

Figure 3B:
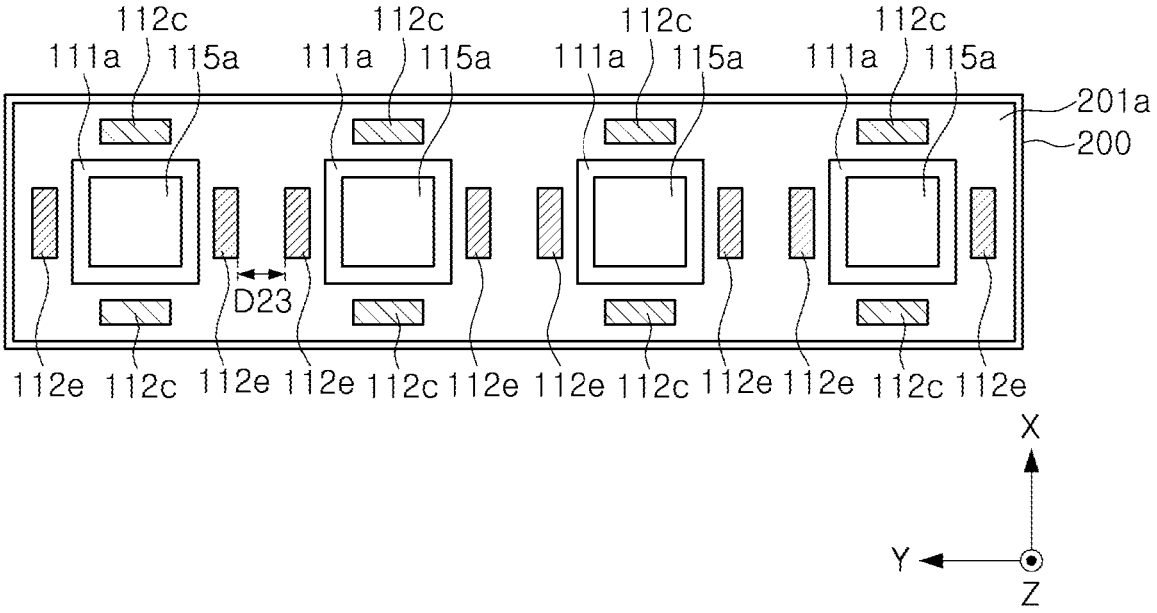
FIG. 3B is a plan view illustrating a structure in which a second patch antenna pattern surrounds a first patch antenna pattern in an antenna apparatus according to an example embodiment of the present disclosure.

FIG. 3B is a plan view illustrating a structure in which a second patch antenna pattern surrounds a first patch antenna pattern in an antenna apparatus according to an example embodiment Referring to FIG. 3B, a plurality of second patch antenna patterns 112*c* and 112*e* may be arranged to surround the plurality of first patch antenna patterns 111*a*, respectively.

Accordingly, portions of the plurality of second patch antenna patterns 112*c* and 112*e* may be disposed such that each of the plurality of first patch antenna patterns 111*a* may be disposed in a region between the portions of the plurality of second patch antenna patterns 112*c* and 112*e* taken in the second direction (e.g., an x direction), and the other portions may be disposed such that each of the plurality of first patch antenna patterns 111*a* may be disposed in a region between the other portions taken in the first direction (e.g., a y direction).

A shortest spacing distance D23 between the plurality of second patch antenna patterns 112*c* and 112*e* may correspond to a second wavelength of a second RF signal which the plurality of second patch antenna patterns 112*c* and 112*e* transmit and/or receive.

The second patch antenna pattern 112*e* of the plurality of second patch antenna patterns 112*c* and 112*e* spaced apart from the plurality of first patch antenna patterns 111*a* in the first direction (e.g., a y direction) may be configured to extend in the second direction (e.g., an x direction), and the second patch antenna pattern 112*c* spaced apart from the plurality of first patch antenna patterns 111*a* in the second direction (e.g., an x direction) may be configured to extend in the first direction (e.g., a y direction).

Accordingly, a length of the antenna apparatus taken in the second direction (e.g., an x direction) may be reduced in the example embodiment.

A first electromagnetic boundary condition of the second patch antenna pattern 112*e* of the plurality of second patch antenna patterns 112*c* and 112*e* spaced apart from the plurality of first patch antenna patterns 111*a* in the first direction (e.g., a y direction) may be different from a second electromagnetic boundary condition of the second patch antenna pattern 112*c* spaced apart from the plurality of first patch antenna patterns 111*a* in the second direction (e.g., an x direction).

In the antenna apparatus in the example embodiment, by including the plurality of second patch antenna patterns 112*c* and 112*e*, a portion of which is a dummy patch antenna pattern, distortion of a radiation pattern, caused as the first electromagnetic boundary condition is different from the second electromagnetic boundary condition, may be prevented, and gains in relation to the second RF signal may improve.

Figure 3C:
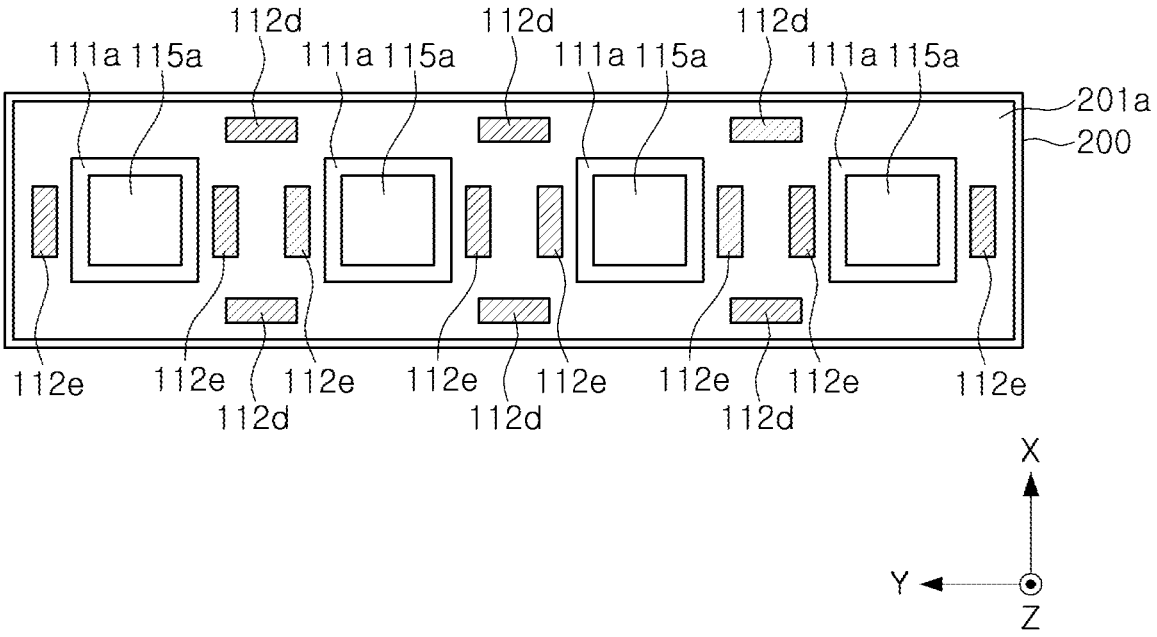
FIG. 3C is a plan view illustrating a structure in which a second patch antenna pattern surrounds a region between first patch antenna patterns in an antenna apparatus according to an example embodiment of the present disclosure.
Figure 3D:
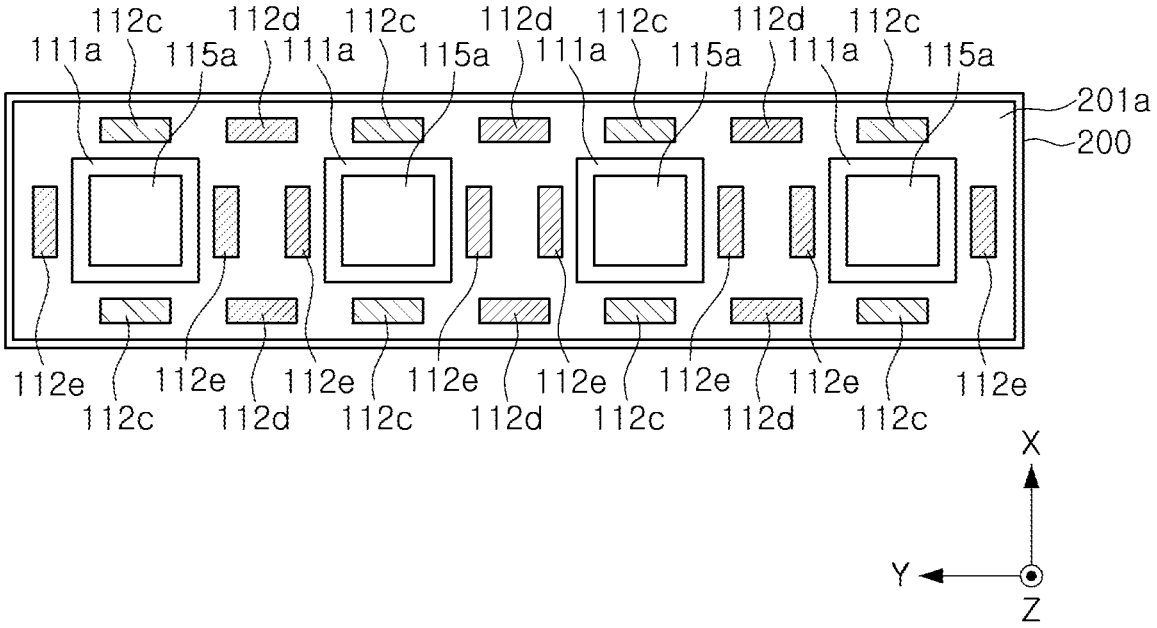
FIG. 3D is a plan view illustrating a structure in which a portion of a second patch antenna pattern is used to surround a region between first patch antenna patterns and to surround a first patch antenna pattern in an antenna apparatus according to an example embodiment of the present disclosure.

FIG. 3C is a plan view illustrating a structure in which a second patch antenna pattern surrounds a region between first patch antenna patterns in an antenna apparatus according to an example embodiment. FIG. 3D is a plan view illustrating a structure in which a portion of a second patch antenna pattern is used to surround a region between first patch antenna patterns and to surround a first patch antenna pattern in an antenna apparatus according to an example embodiment.

Referring to FIGS. 3C and 3D, at least portions of a plurality of second patch antenna patterns 112*c*, 112*d*, and 112*e* may be arranged to surround a plurality of regions between the plurality of first patch antenna patterns 111*a* and to surround the plurality of first patch antenna patterns 111*a*, respectively.

A length of each of the plurality of regions taken in the second direction (e.g., an x direction) surrounded by the portions of the plurality of second patch antenna patterns 112*c*, 112*d*, and 112*e* may be longer than a length of each of the plurality of regions taken in the first direction (e.g., a y direction).

Accordingly, shortest spacing distances among the plurality of second patch antenna patterns 112*c*, 112*d*, and 112*e* may correspond to a second wavelength of a second RF signal and may be uniformly formed, and accordingly, gains of the plurality of second patch antenna patterns 112*c*, 112*d*, and 112*e* may improve.

Referring to FIG. 3D, a portion of the plurality of second patch antenna patterns 112*c*, 112*d*, and 112*e*, the second patch antenna pattern 112*e*, may be used to surround the plurality of regions between the plurality of first patch antenna patterns 111*a* and to surround the plurality of first patch antenna patterns 111*a*.

Accordingly, even when the first spacing distance between the plurality of first patch antenna patterns 111*a* is not substantially changed, the shortest spacing distances among the plurality of second patch antenna patterns 112*c*, 112*d*, and 112*e* may correspond to the second wavelength of the second RF signal, and may be uniformly formed. Thus, the antenna apparatus in the example embodiment may have improved gains in relation to the first and second RF signals.

A combination of a first structure of the second patch antenna patterns 112*d* and 112*e* of the plurality of second patch antenna patterns 112*c*, 112*d*, and 112*e* surrounding the plurality of regions and a second structure of the second patch antenna patterns 112*c* and 112*e* surrounding the plurality of first patch antenna patterns 111*a* may alleviate distortion of a radiation pattern caused by a difference between the electromagnetic boundary conditions of the plurality of second patch antenna patterns 112*c*, 112*d*, and 112*e*. Thus, efficiency of overlapping of an integrated radiation pattern of the plurality of second patch antenna patterns 112*c*, 112*d*, and 112*e* may improve, and gains of the plurality of second patch antenna patterns 112*c*, 112*d*, and 112*e* may improve.

Figure 4A:
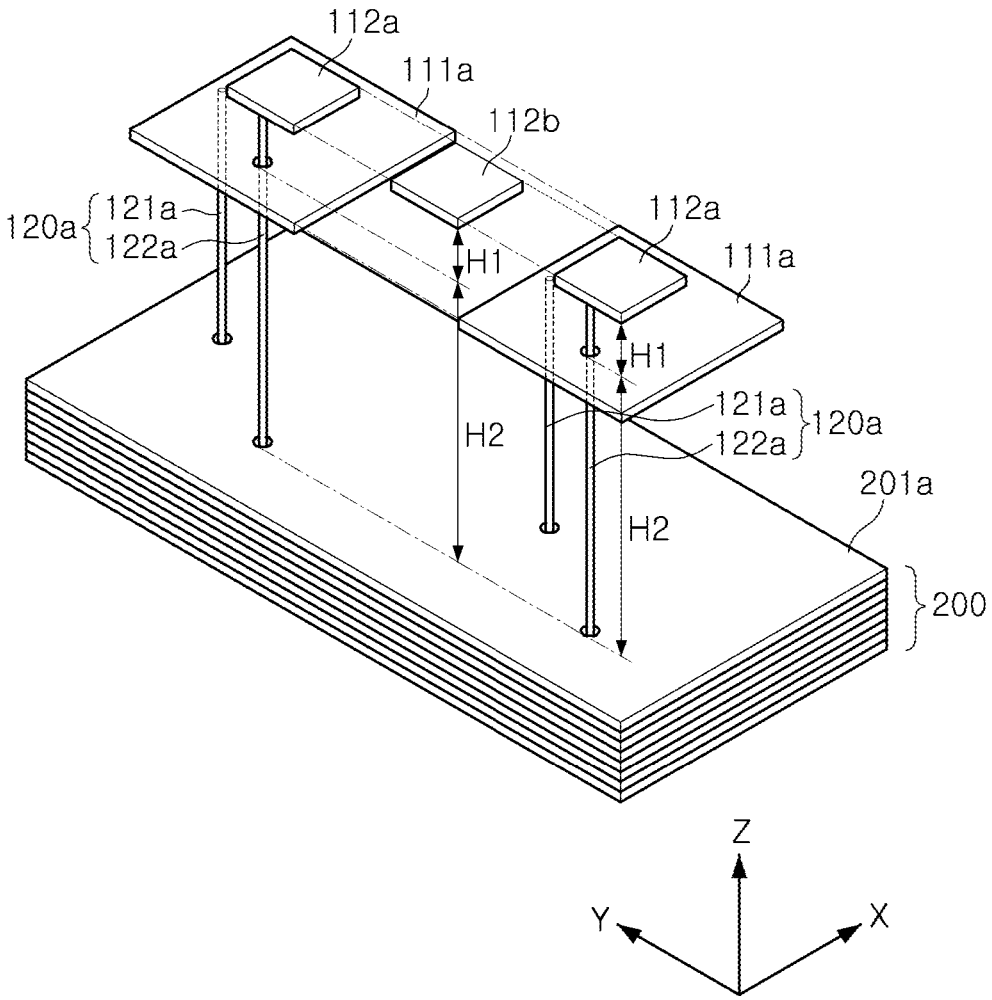
FIG. 4A is a perspective view illustrating an antenna apparatus according to an example embodiment of the present disclosure.
Figure 5A:
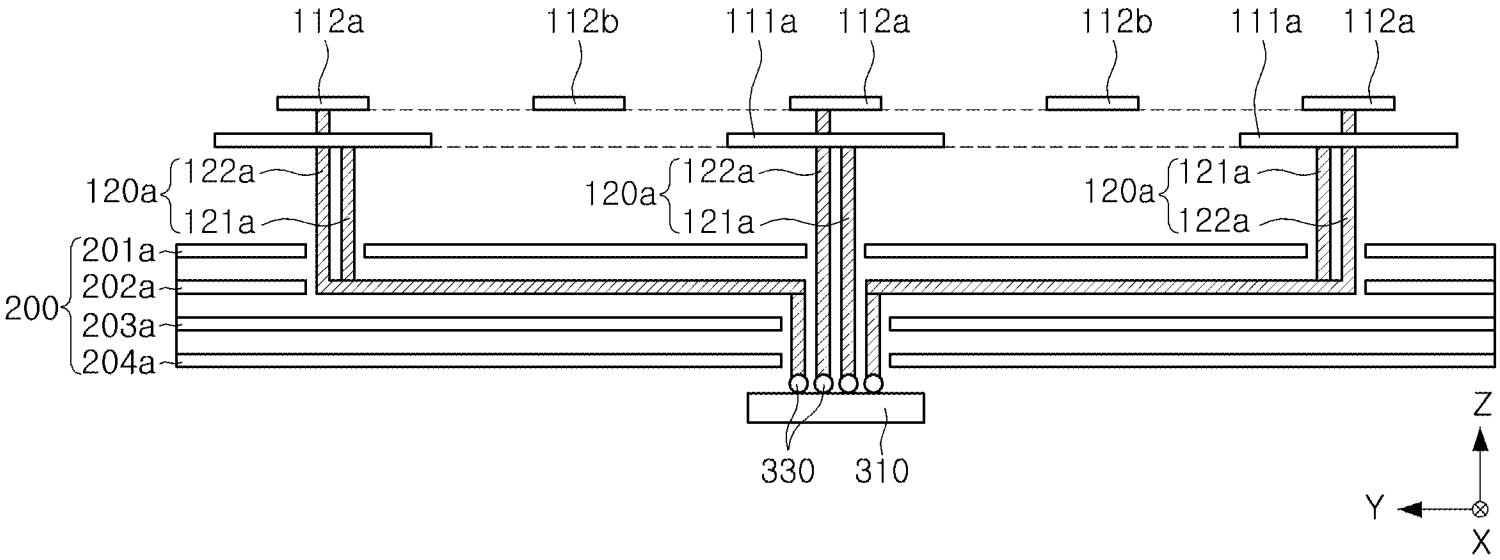
FIG. 5A is a side view illustrating an antenna apparatus according to an example embodiment of the present disclosure.

FIG. 4A is a perspective view illustrating an antenna apparatus according to an example embodiment. FIG. 5A is a side view illustrating an antenna apparatus according to an example embodiment.

Referring to FIGS. 4A and 5A, a plurality of second patch antenna patterns 112*a* and 112*b* may be disposed on a level higher than a plurality of first patch antenna patterns 111*a* by a first height H1, and the plurality of first patch antenna patterns 111*a* may be disposed on a level higher than the ground plane 201*a* by a second height H2.

The antenna apparatus in the example embodiment may include a plurality of feed vias 120*a*, and the plurality of feed vias 120*a* may include a plurality of second feed vias 122*a* and may further include a plurality of first feed vias 121*a*.

The plurality of second feed vias 122*a* may provide a feed path for at least one feed patch antenna pattern 112*a* of the plurality of second patch antenna patterns, and may penetrate the ground plane 201*a*. A dummy patch antenna pattern 112*b* may not be provided with a feed path from the plurality of second feed vias 122*a*.

The plurality of first feed vias 121*a* may provide a feed path for a corresponding first patch antenna pattern of the plurality of first patch antenna patterns 111*a*, and may penetrate the ground plane 201*a*.

The plurality of first and second feed vias 121*a* and 122*a* may provide electrical connection paths between an integrated circuit (IC) and the patch antenna patterns, and may work as a transmission path of the first, second, and third RF signals.

The plurality of first and second feed vias 121*a* and 122*a* may be configured to extend in the upward and downward directions (e.g., a z direction), and may easily reduce an electrical length between an IC electrically connected to a connection member 200 and the patch antenna pattern.

Figure 4B:
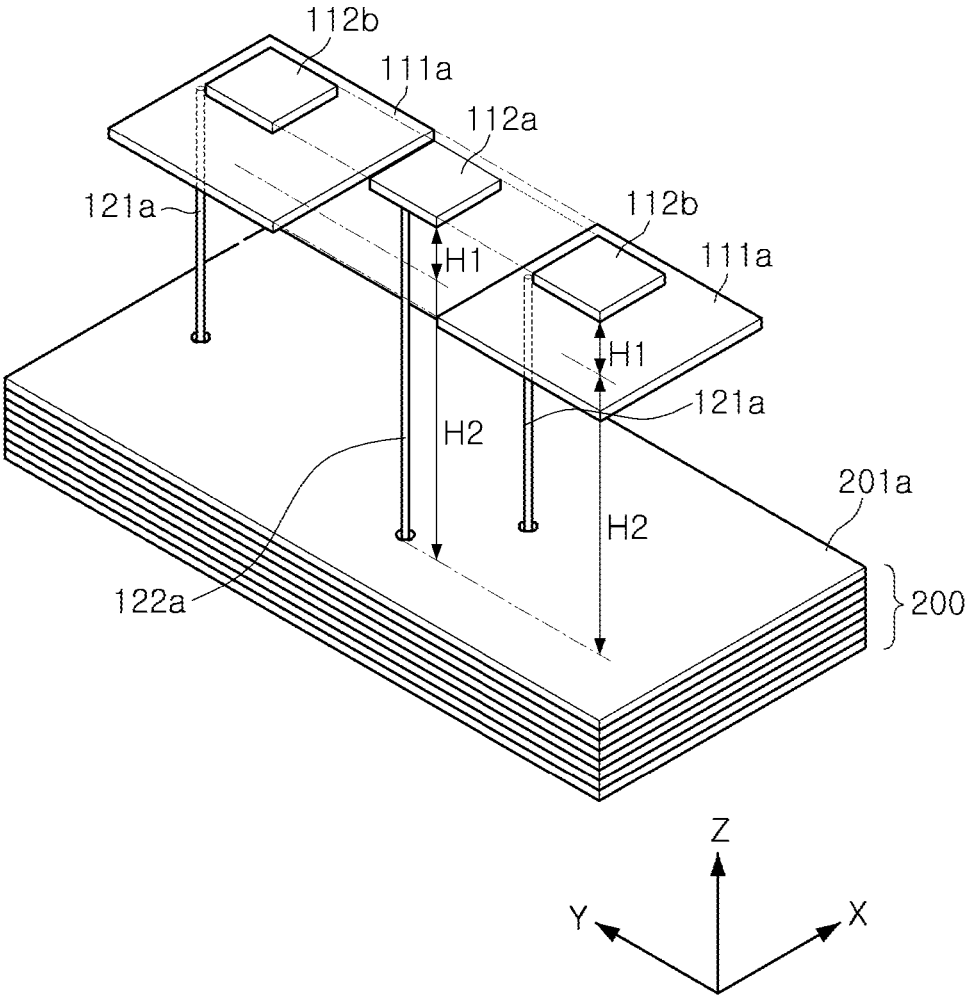
FIG. 4B is a perspective view illustrating an example in which a position of a feed/dummy patch antenna pattern is changed in an antenna apparatus according to an example embodiment of the present disclosure.
Figure 5B:
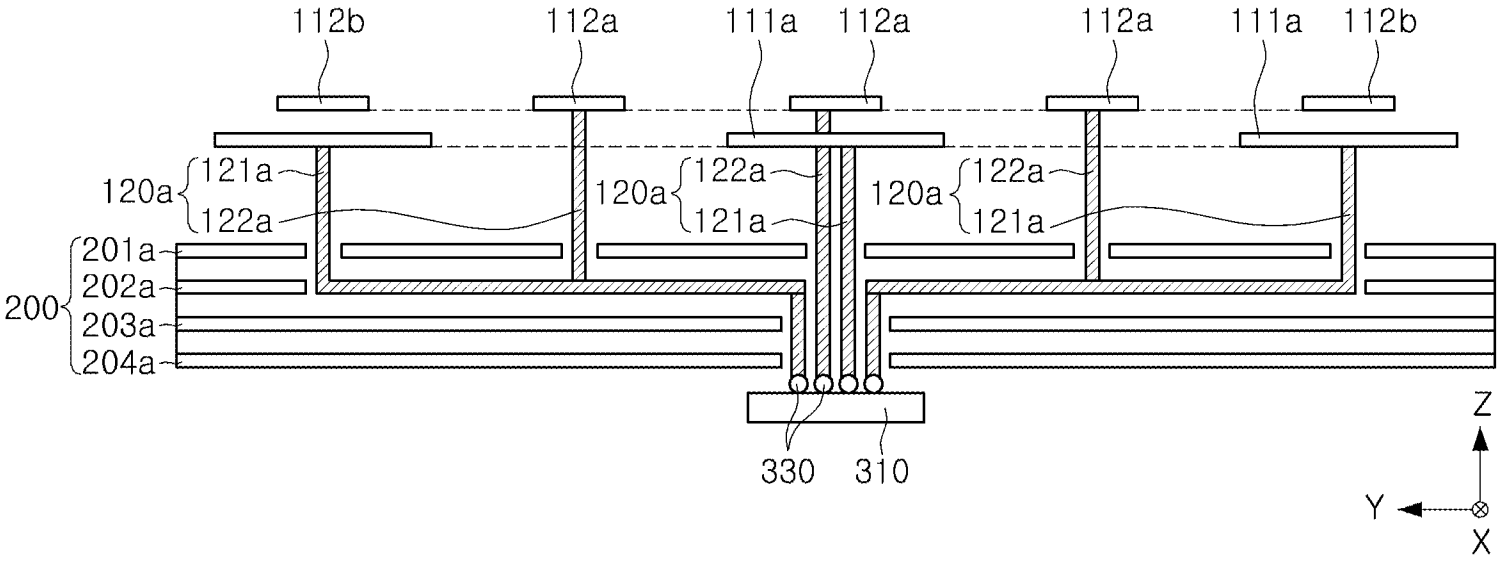
FIG. 5B is a side view illustrating an example in which a position of a feed/dummy patch antenna pattern is changed in an antenna apparatus according to an example embodiment of the present disclosure.

FIG. 4B is a perspective view illustrating an example in which a position of a feed/dummy patch antenna pattern is changed in an antenna apparatus according to an example embodiment. FIG. 5B is a side view illustrating an example in which a position of a feed/dummy patch antenna pattern is changed in an antenna apparatus according to an example embodiment.

Referring to FIGS. 4B and 5B, the feed patch antenna pattern 112*a* may be disposed to not overlap the plurality of first patch antenna patterns 111*a* in the upward and downward directions (e.g., a z direction), and the dummy patch antenna pattern 112*b* may be disposed to overlap the plurality of first patch antenna patterns 111*a* in the upward and downward directions (e.g., a z direction).

Thus, the positions of the feed patch antenna pattern 112*a* and the dummy patch antenna pattern 112*b* may not be limited by whether the feed patch antenna pattern 112*a* and the dummy patch antenna pattern 112*b* overlap the plurality of first patch antenna patterns 111*a*.

Figure 4C:
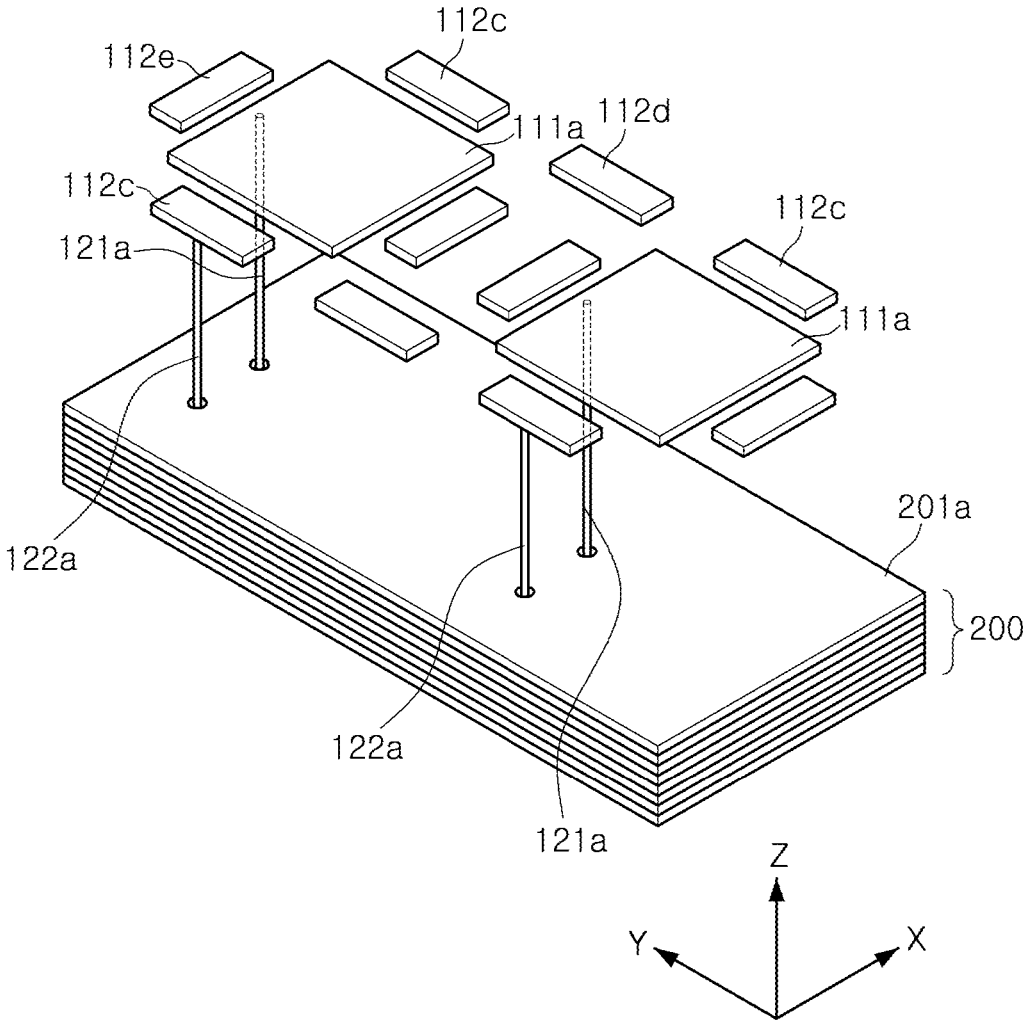
FIG. 4C is a perspective view illustrating a structure in which a portion of a second patch antenna pattern is used to surround a region between first patch antenna patterns and to surround a first patch antenna pattern in an antenna apparatus according to an example embodiment of the present disclosure.
Figure 4D:
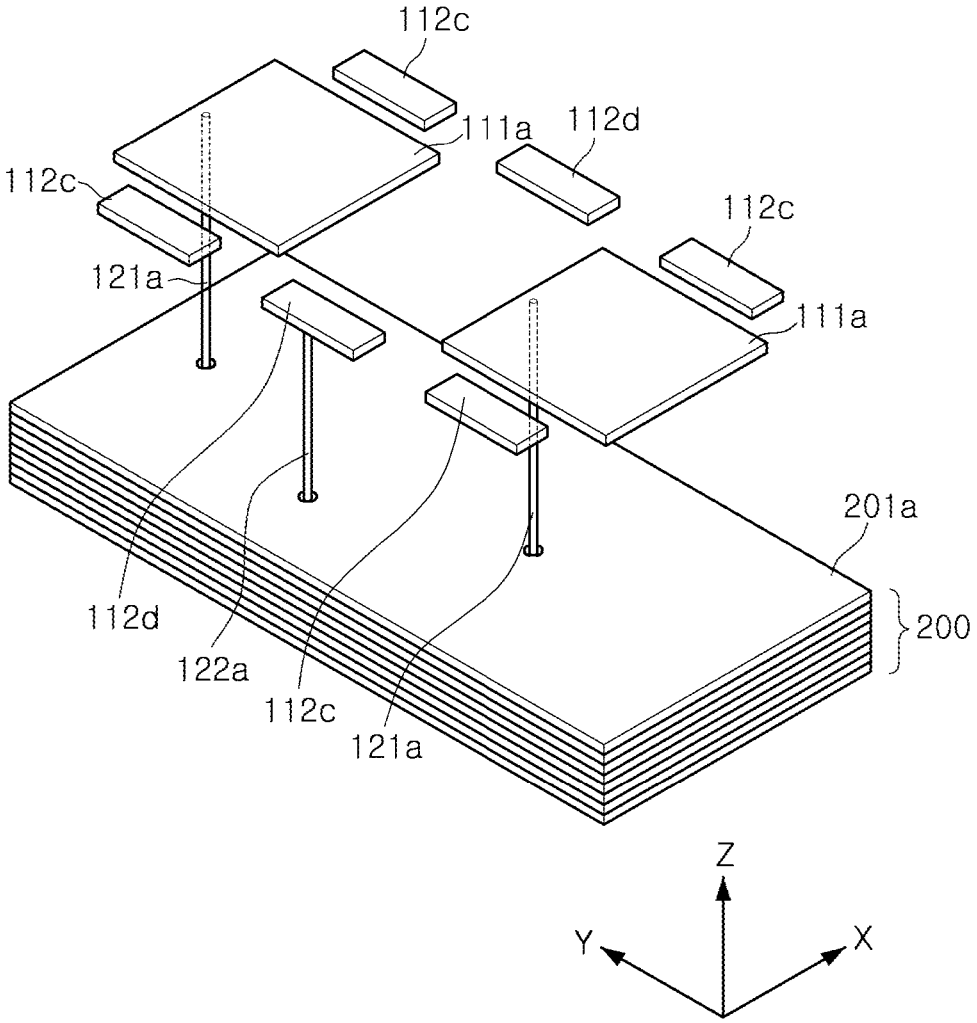
FIG. 4D is a perspective view illustrating an arrangement structure in which first and second patch antenna patterns do not overlap each other in an antenna apparatus according to an example embodiment of the present disclosure.
Figure 5C:
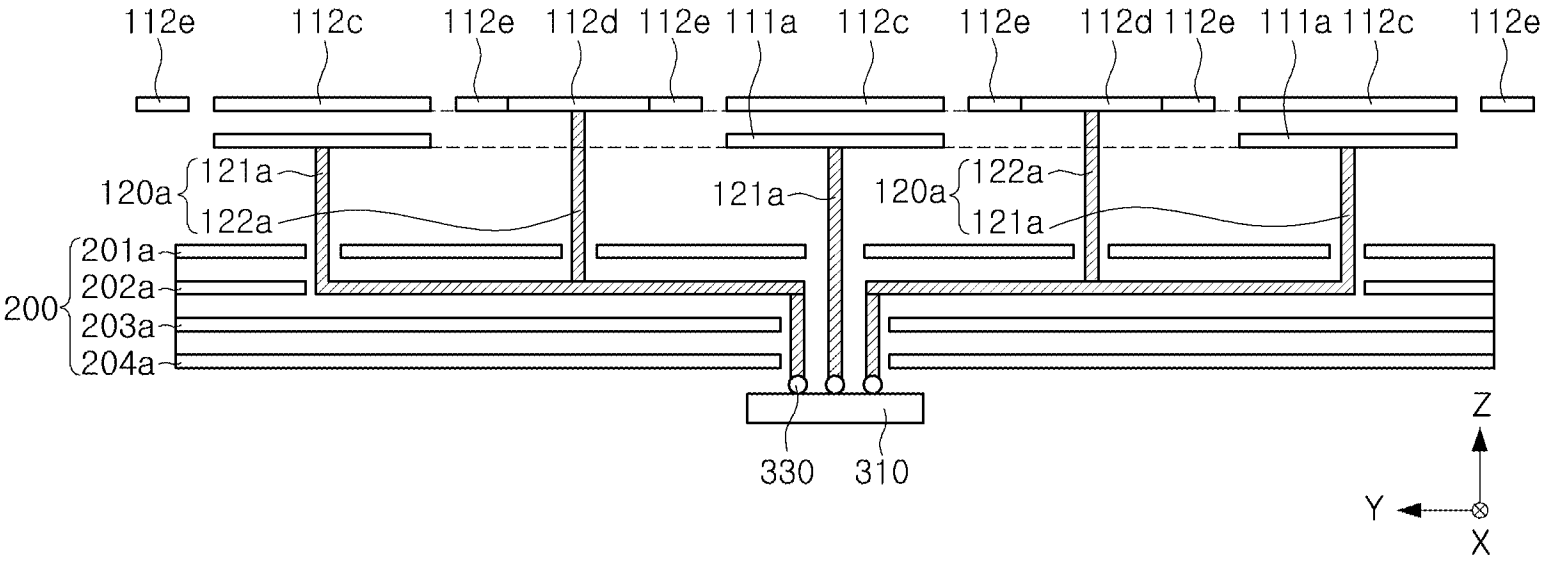
FIG. 5C is a side view illustrating a structure in which a second patch antenna pattern surrounds a region between first patch antenna patterns in an antenna apparatus according to an example embodiment of the present disclosure.

FIG. 4C is a perspective view illustrating a structure in which a portion of a second patch antenna pattern is used to surround a region between first patch antenna patterns and to surround a first patch antenna pattern in an antenna apparatus according to an example embodiment. FIG. 4D is a perspective view illustrating an arrangement structure in which first and second patch antenna patterns do not overlap each other in the upward and downward directions (e.g., a z direction) in an antenna apparatus according to an example embodiment. FIG. 5C is a side view illustrating a structure in which a second patch antenna pattern surrounds a region between first patch antenna patterns in an antenna apparatus according to an example embodiment.

Referring to FIGS. 4C, 4D, and 5C, at least portions of a plurality of second patch antenna patterns 112*c*, 112*d*, and 112*e* may be provided with a feed path from the plurality of second feed vias 122*a*.

Figure 4E:
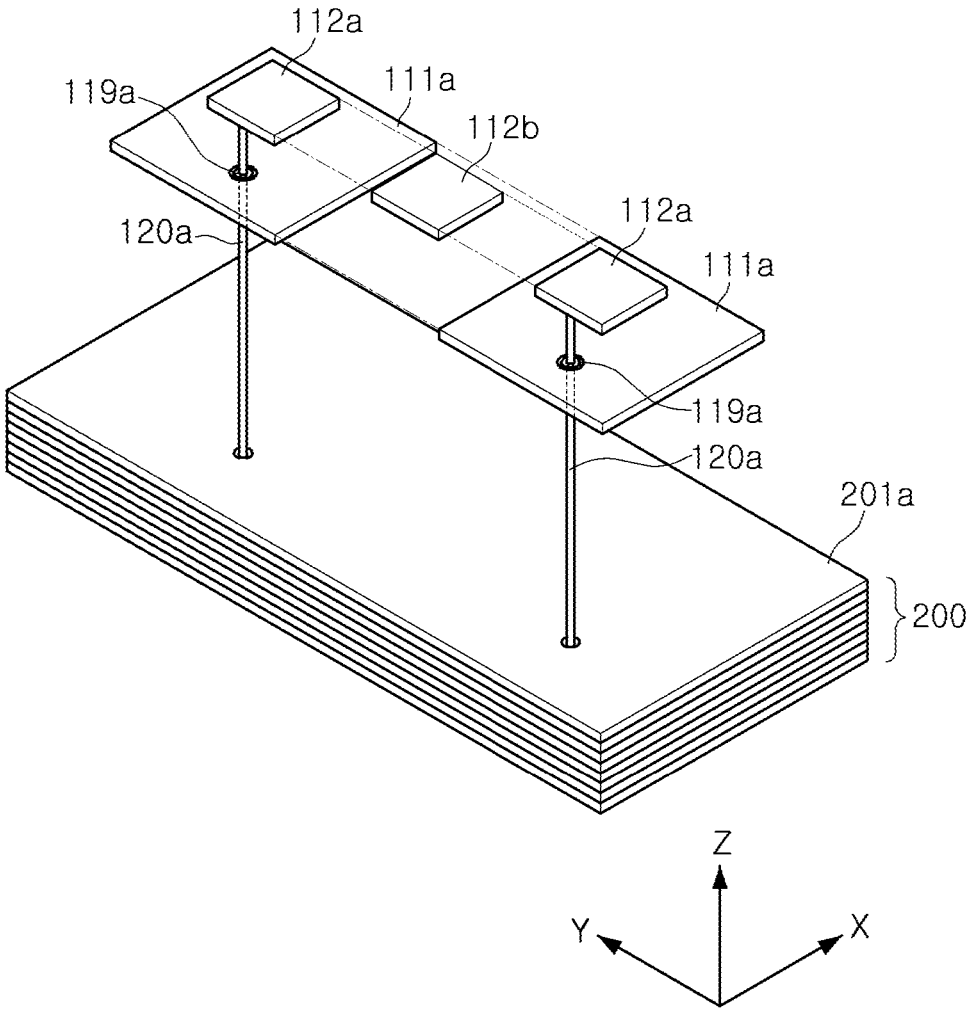
FIG. 4E is a perspective view illustrating a feed structure of a feed via of an antenna apparatus according to an example embodiment of the present disclosure.

FIG. 4E is a perspective view illustrating a feed structure of a feed via of an antenna apparatus according to an example embodiment.

Referring to FIG. 4E, the feed patch antenna pattern 112*a* may be directly fed with power from the plurality of feed vias 120*a* as the feed patch antenna pattern 112*a* is in contact with the plurality of feed vias 120*a*, and the plurality of first patch antenna patterns 111*a* may be indirectly fed with power through a feed pattern 119*a*. Accordingly, the plurality of feed vias 120*a* may provide a feed path of the first patch antenna pattern 111*a* and a feed path of the feed patch antenna pattern 112*a*.

A feed structure in the antenna apparatus in the example embodiment is not limited to any particular method.

Figure 4F:
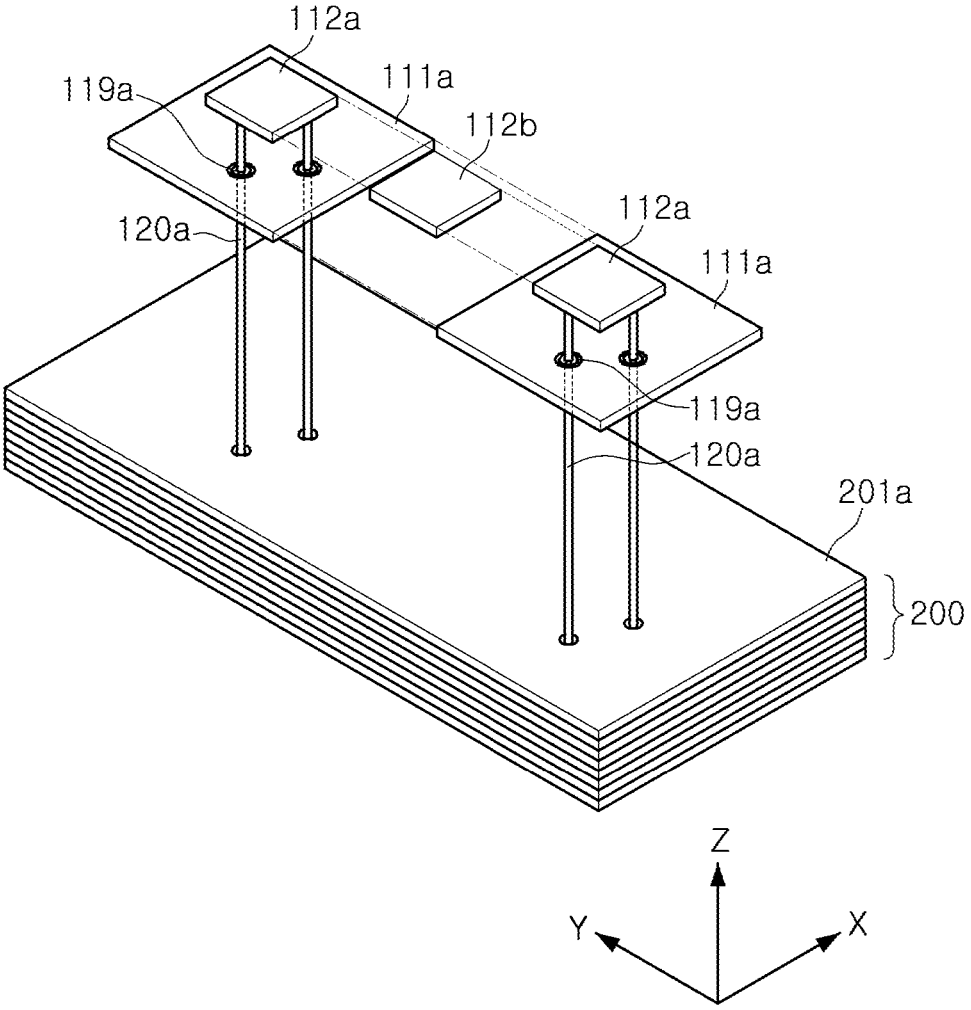
FIG. 4F is a perspective view illustrating a feed structure of a feed via of an antenna apparatus according to an example embodiment of the present disclosure.

FIG. 4F is a perspective view illustrating a feed structure of a feed via of an antenna apparatus according to an example embodiment.

Referring to FIG. 4F, the plurality of first patch antenna patterns 111*a* may be electrically connected to two or more of the plurality of feed vias 120*a*, respectively.

Similarly, a plurality of the feed patch antenna patterns 112*a* may be electrically connected to two or more of the plurality of feed vias 120*a*, respectively.

Referring to FIGS. 5A, 5B, and 5C, a connection member 200 may include a ground plane 201*a*, a wiring ground plane 202*a*, a second ground plane 203*a*, and an IC ground plane 204*a*, and may have a lower surface to which a plurality of electrical interconnect structures 330 are connected.

The plurality of electrical interconnect structures 330 may electrically connect an IC 310 to the connection member 200, and may have a structure such as a pin, a land, or a pad, but an example embodiment thereof is not limited thereto.

Figure 6A:
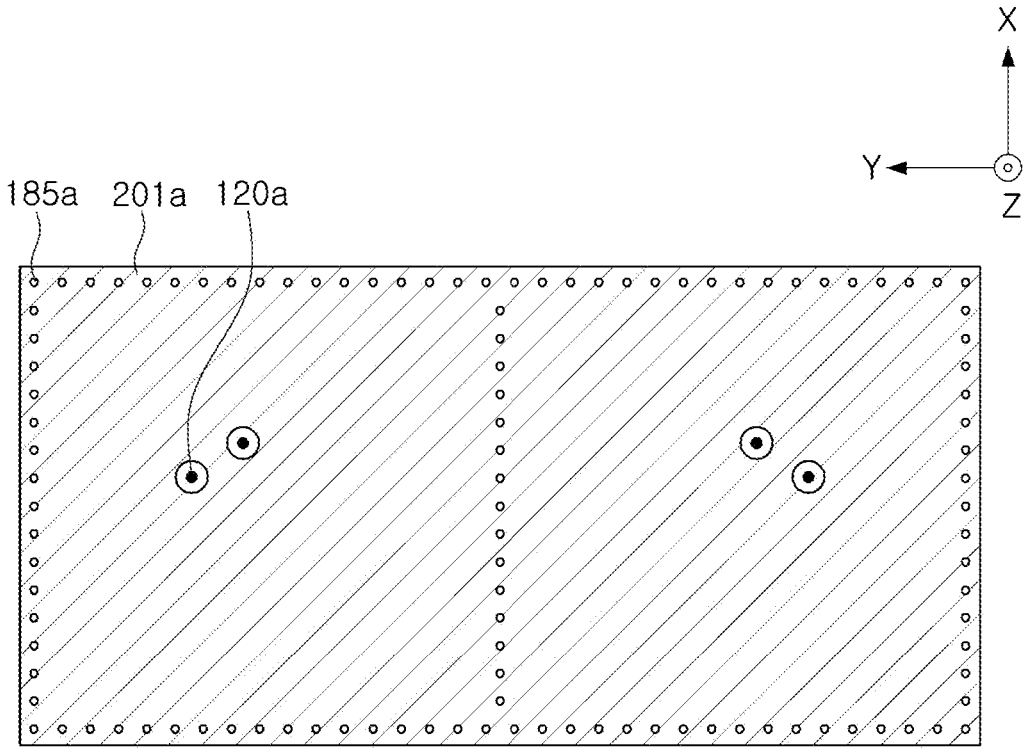
FIG. 6A is a plan view illustrating a ground plane of an antenna apparatus according to an example embodiment of the present disclosure.
Figure 6B:
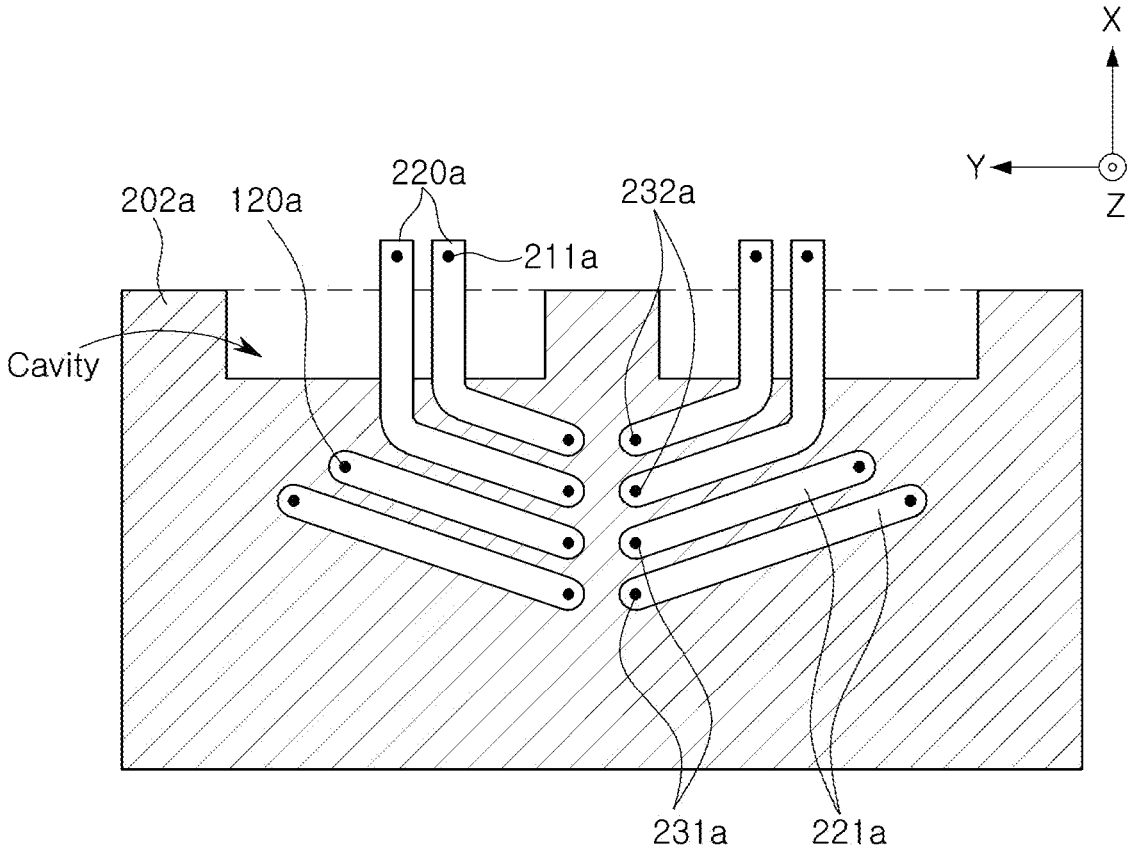
FIG. 6B is a plan view illustrating a feed line disposed on a lower side of the ground plane illustrated in FIG. 6A according to an example embodiment of the present disclosure.
Figure 6C:
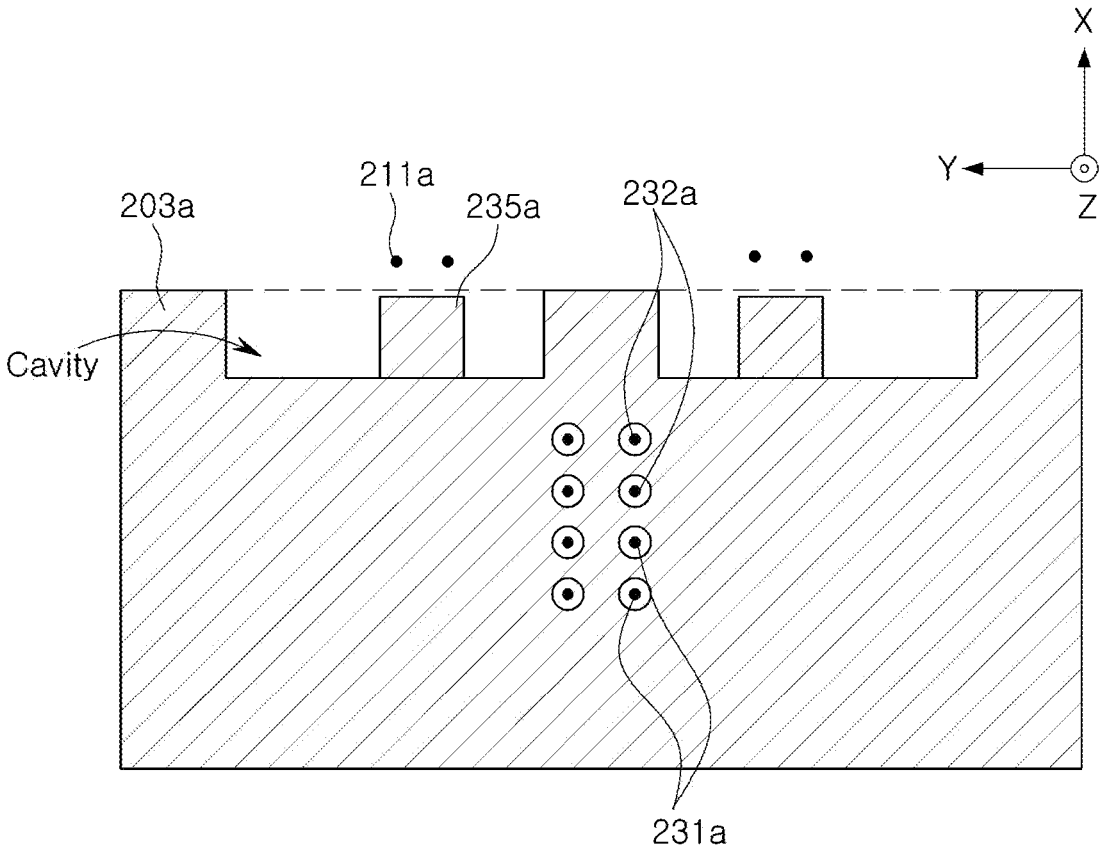
FIG. 6C is a plan view illustrating a wiring via and a second ground plane disposed on a lower side of the feed line illustrated in FIG. 6B according to an example embodiment of the present disclosure.
Figure 6D:
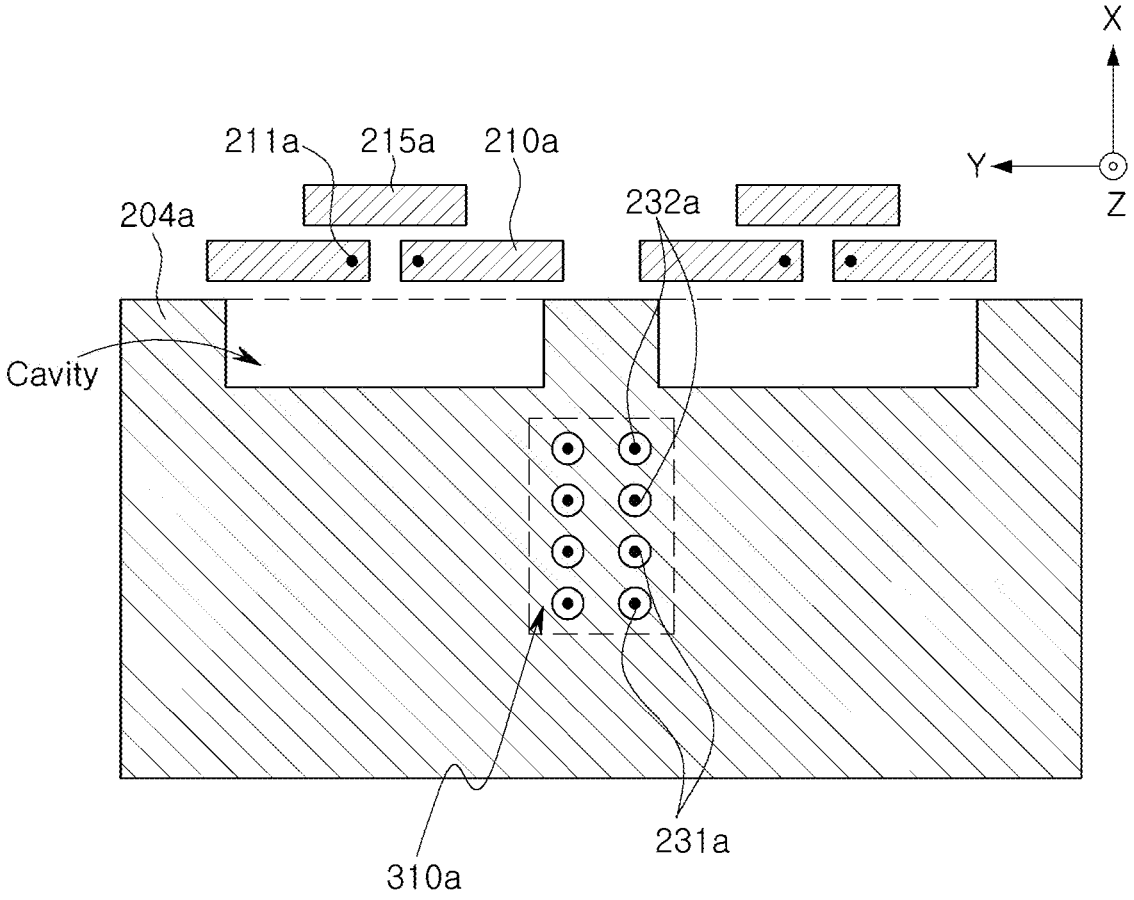
FIG. 6D is a plan diagram illustrating an IC dispositional region and an end-fire antenna disposed on a lower side of the second ground plane illustrated in FIG. 6C according to an example embodiment of the present disclosure.

FIG. 6A is a plan view illustrating a ground plane of an antenna apparatus according to an example embodiment. FIG. 6B is a plan view illustrating a feed line disposed on a lower side of the ground plane illustrated in FIG. 6A according to an example embodiment. FIG. 6C is a plan view illustrating a wiring via and a second ground plane disposed on a lower side of the feed line illustrated in FIG. 6B according to an example embodiment. FIG. 6D is a plan diagram illustrating an IC dispositional region and an end-fire antenna disposed on a lower side of the second ground plane illustrated in FIG. 6C according to an example embodiment.

In FIGS. 6A to 6D, a patch antenna pattern 110*a* may represent the first and second patch antenna patterns described in the aforementioned example embodiments in a comprehensive manner.

Referring to FIG. 6A, a ground plane 201*a* may have a through-hole through which a feed via 120*a* penetrates, and may electromagnetically shield a region between the patch antenna pattern 110*a* and a feed line. A second shielding via 185*a* may extend towards a lower side (e.g., a z direction).

Referring to FIG. 6B, a wiring ground plane 202*a* may surround at least a portion of an end-fire antenna feed line 220*a* and a feed line 221*a*. The end-fire antenna feed line 220*a* may be electrically connected to a second wiring via 232*a*, and the feed line 221*a* may be electrically connected to a first wiring via 231*a*. The wiring ground plane 202*a* may electromagnetically shield a region between the end-fire antenna feed line 220*a* and the feed line 221*a*. One end of the end-fire antenna feed line 220*a* may be connected to a second feed via 211*a*.

Referring to FIG. 6C, a second ground plane 203*a* may have a plurality of through-holes through which the first wiring via 231*a* and the second wiring via 232*a* penetrate, respectively, and may have a coupling ground pattern 235*a*. The second ground plane 203*a* may electromagnetically shield a region between a feed line and an IC.

Referring to FIG. 6D, an IC ground plane 204*a* may have a plurality of through-holes through which the first wiring via 231*a* and the second wiring via 232*a* penetrate, respectively. The IC 310*a* may be disposed on a lower side of the IC ground plane 204*a*, and may be electrically connected to the first wiring via 231*a* and the second wiring via 232*a*. An end-fire antenna pattern 210*a* and a director pattern 215*a* may be disposed on a level substantially the same as a level of an IC ground plane 204*a*.

The IC ground plane 204*a* may provide a ground used in a circuit of the IC 310*a* and/or a passive component to the IC 310*a* and/or a passive component. In example embodiments, the IC ground plane 204*a* may provide a transfer path of power and a signal used in the IC 310*a* and/or a passive component. Accordingly, the IC ground plane 204*a* may be electrically connected to the IC and/or a passive component.

Each of the wiring ground plane 202*a*, the second ground plane 203*a*, and the IC ground plane 204*a* may be configured to be recessed to provide a cavity. Accordingly, the end-fire antenna pattern 210*a* may be disposed adjacent to the IC ground plane 204*a*.

Upward and downward relationships and forms of the ground plane 201*a*, the wiring ground plane 202*a*, the second ground plane 203*a*, and the IC ground plane 204*a* may be varied in example embodiments.

Figure 7A:
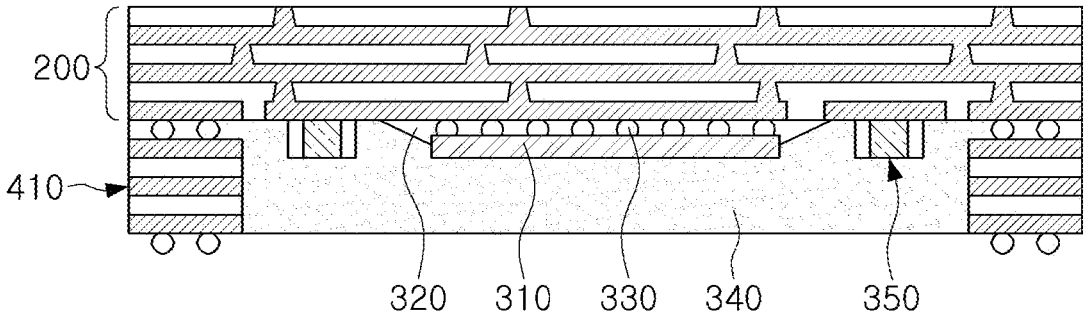
FIGS. 7A and 7B are side views illustrating the portion illustrated in FIGS. 6A to 6D and a structure of a lower side of the portion according to an example embodiment of the present disclosure.
Figure 7B:
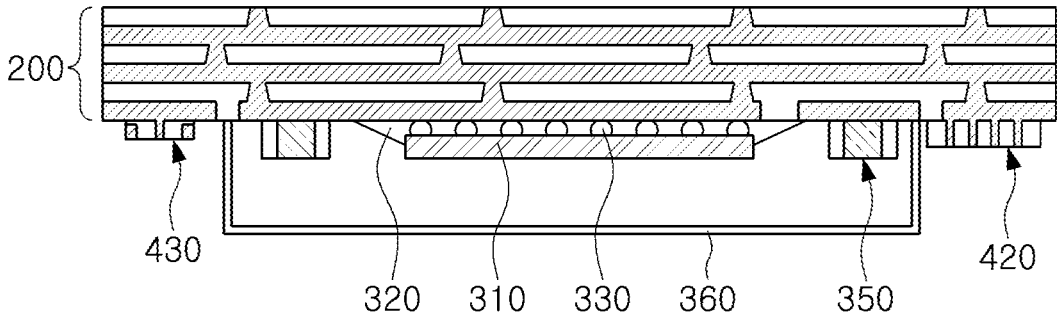

FIGS. 7A and 7B are side views illustrating the portion illustrated in FIGS. 6A to 6D and a structure of a lower side of the portion.

Referring to FIG. 7A, an antenna apparatus in the example embodiment may include at least portions of a connection member 200, an IC 310, an adhesive member 320, an electrical interconnect structure 330, an encapsulant 340, a passive component 350, and a core member 410.

The connection member 200 may have a structure having a predetermined pattern in which a plurality of metal layers and a plurality of insulating layers are layered, similarly to a printed circuit board (PCB).

The IC 310 may be the same as the above-described IC, and may be disposed on a lower side of the connection member 200. The IC 310 may be electrically connected to a wiring line of the connection member 200, and may transmit and/or receive an RF signal. The IC 310 may also be electrically connected to a ground plane of the connection member 200 and may be grounded. For example, the IC 310 may generate a converted signal by performing at least portions of frequency conversion, amplification, filtering, a phase control, and power generation.

The adhesive member 320 may allow the IC 310 and the connection member 200 to be bonded to each other.

The electrical interconnect structure 330 may electrically connect the IC 310 and the connection member 200 to each other. The electrical interconnect structure 330 may have a structure such as a solder ball, a pin, a land, and a pad. The electrical interconnect structure 330 may have a melting point lower than melting points of a wiring line and a ground plane of the connection member 200 and may electrically connect the IC 310 and the connection member 200 to each other through a required process using the low melting point.

The encapsulant 340 may encapsulate at least a portion of the IC 310, and may improve a heat dissipation performance and a protection performance against impacts. For example, the encapsulant 340 may be implemented by a photoimageable encapsulant (PIE), an Ajinomoto build-up film (ABF), an epoxy molding compound (EMC), and the like.

The passive component 350 may be disposed on a lower surface of the connection member 200, and may be electrically connected to a wiring line and/or a ground plane of the connection member 200 through the interconnect structure 330. For example, the passive component 350 may include at least portions of a capacitor (e.g., a multilayer ceramic capacitor, MLCC), an inductor, and a chip resistor.

The core member 410 may be disposed on a lower surface of the connection member 200, and may be electrically connected to the connection member 200 to receive an intermediate frequency (IF) signal or a baseband signal from an external entity and to transmit the signal to the IC 310, or to receive an IF signal or a baseband signal from the IC 310 and to transmit the signal to an external entity. A frequency (e.g., 24 GHz, 28 GHz, 36 GHz, 39 GHz, 60 GHz) of the RF signal may be greater than a frequency (e.g., 2 GHz, 5 GHz, 10 GHz, and the like) of the IF signal.

For example, the core member 410 may transmit an IF signal or a baseband signal to the IC 310 or may receive the signal from the IC 310 through a wiring line included in an IC ground plane of the connection member 200. As a first ground plane of the connection member 200 is disposed between the IC ground plane and a wiring line, an IF signal or a baseband signal and an RF signal may be electrically isolated from each other in an antenna apparatus.

Referring to FIG. 7B, the antenna apparatus in the example embodiment may include at least portions of a shielding member 360, a connector 420, and an end-fire chip antenna 430.

The shielding member 360 may be disposed on a lower side of the connection member 200 and may enclose the IC 310 along with the connection member 200. For example, the shielding member 360 may cover or conformally shield the IC 310 and the passive component 350 together, or may separately cover or compartment-shield the IC 310 and the passive component 350. For example, the shielding member 360 may have a hexahedral shape in which one surface is open, and may have an accommodating space having a hexahedral form by being combined with the connection member 200. The shielding member 360 may be implemented by a material having relatively high conductivity such as copper, such that the shielding member 360 may have a skin depth, and the shielding member 360 may be electrically connected to a ground plane of the connection member 200. Accordingly, the shielding member 360 may reduce electromagnetic noise which the IC 310 and the passive component 350 receive.

The connector 420 may have a connection structure of a cable (e.g., a coaxial cable or a flexible PCB), may be electrically connected to the IC ground plane of the connection member 200, and may work similarly to the above-described sub-substrate. Accordingly, the connector 420 may be provided with an IF signal, a baseband signal, and/or power from a cable, or may provide an IF signal and/or a baseband signal to a cable.

The end-fire chip antenna 430 may transmit and/or receive an RF signal in addition to the antenna apparatus. For example, the chip antenna 430 may include a dielectric block having a dielectric constant higher than that of an insulating layer, and a plurality of electrodes disposed on both surfaces of the dielectric block. One of the plurality of electrodes may be electrically connected to a wiring line of the connection member 200, and the other one of the plurality of electrodes may be electrically connected to a ground plane of the connection member 200.

Figure 8A:
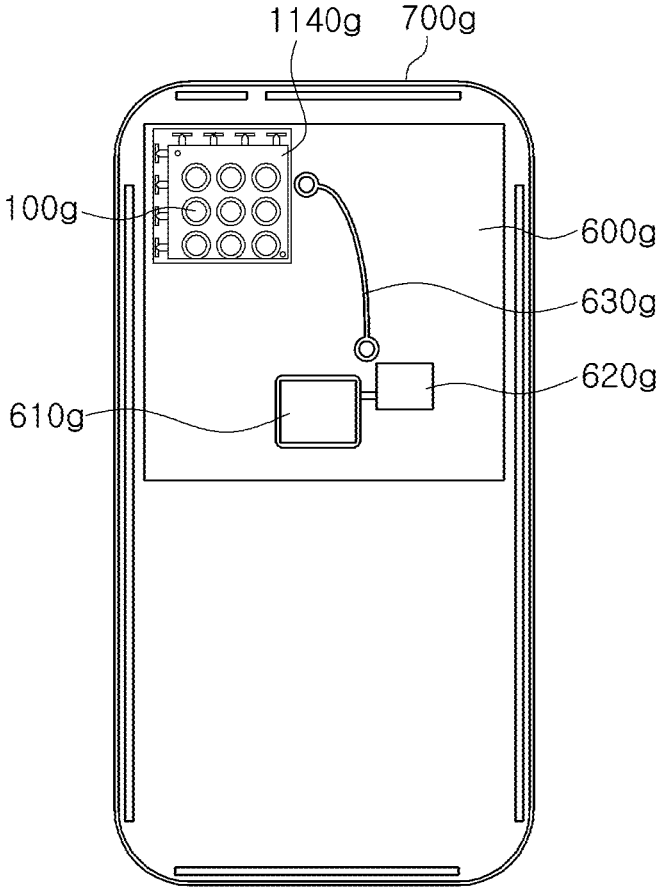
FIGS. 8A and 8B are plan views illustrating an example of an electronic device in which an antenna apparatus is disposed according to an example embodiment of the present disclosure.
Figure 8B:
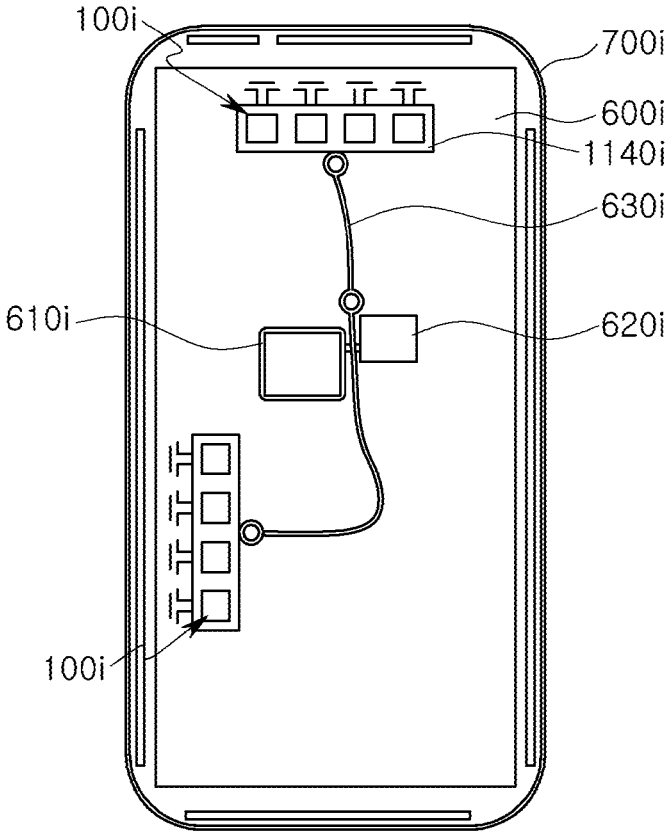

FIGS. 8A and 8B are plan views illustrating an example of an electronic device in which an antenna apparatus is disposed.

Referring to FIG. 8A, an antenna apparatus including an antenna portion 100*g* may be disposed adjacent to a side surface boundary of an electronic device 700*g* on a set substrate 600*g* of the electronic device 700*g*.

The electronic device 700*g* may be implemented as a smartphone, a personal digital assistant, a digital video camera, a digital still camera, a network system, a computer, a monitor, a tablet PC, a laptop PC, a netbook PC, a television, a video game, a smart watch, an automotive component, or the like, but an example of the electronic device 700*g* is not limited thereto.

A communication module 610*g* and a baseband circuit 620*g* may further be disposed on the set substrate 600*g*. The antenna apparatus may be electrically connected to the communication module 610*g* and/or the baseband circuit 620*g* through a coaxial cable 630*g*.

The communication module 610*g* may include at least portions of a memory chip such as a volatile memory (e.g., a DRAM), a non-volatile memory (e.g., a ROM), a flash memory, or the like; an application processor chip such as a central processor (e.g., a CPU), a graphics processor (e.g., a GPU), a digital signal processor, a cryptographic processor, a microprocessor, a microcontroller, or the like; and a logic chip such as an analog-to-digital converter, an application-specific integrated circuit (ASIC), or the like.

The baseband circuit 620*g* may generate a base signal by performing analog-to-digital conversion, and amplification, filtering, and frequency conversion on an analog signal. A base signal input to and output from the baseband circuit 620*g* may be transferred to the antenna apparatus through a cable.

For example, the base signal may be transferred to an IC through an electrical interconnect structure, a cover via, and a wiring line. The IC may convert the base signal into an RF signal of mmWave band.

Referring to FIG. 8B, a plurality of antenna apparatuses each including an antenna portion 100*i* may be disposed adjacent to a one side boundary and the other side boundary of an electronic device 700*i* having a polygonal shape on a set substrate 600*i* of the electronic device 700*i*, and a communication module 610*i* and a baseband circuit 620*i* may further be disposed on the set substrate 600*i*. The plurality of antenna apparatuses may be electrically connected to the communication module 610*i* and/or baseband circuit 620*i* through a coaxial cable 630*i*.

Dielectric layers 1140*g* and 1140*i* may fill a region of the antenna apparatus in which a pattern, a via, a plane, a line, and an electrical interconnect structure are not disposed.

For example, the dielectric layers 1140*g* and 1140*i* may be implemented by a material such as FR4, a liquid crystal polymer (LCP), low temperature co-fired ceramic (LTCC), a thermosetting resin such as an epoxy resin, a thermoplastic resin such as a polyimide resin, a resin in which the above-described resin is impregnated in a core material, such as a glass fiber (or a glass cloth or a glass fabric), together with an inorganic filler, prepreg, a Ajinomoto build-up film (ABF), FR-4, bismaleimide triazine (BT), a photoimagable dielectric (PID) resin, a general copper clad laminate (CCL), glass, a ceramic-based insulating material, or the like. The dielectric layer and the insulating layer may fill at least a portion of a position in which the patch antenna pattern, the feed via, the guide via, the feed pattern, the ground plane, the electrical interconnect structure are not disposed in the antenna apparatus described in the aforementioned example embodiments.

The pattern, the via, the plane, the line, and the electrical interconnect structure described in the aforementioned example embodiments may include a metal material (e.g., a conductive material such as copper (Cu), aluminum (Al), silver (Ag), tin (Sn), gold (Au), nickel (Ni), lead (Pb), titanium (Ti), or alloys thereof), and may be formed by a plating method such as a chemical vapor deposition (CVD) method, a physical vapor deposition (PVD) method, a sputtering method, a subtractive method, an additive method, a semi-additive process (SAP), a modified semi-additive process (MSAP), or the like, but examples of the material and the method are not limited thereto.

The RF signal described in the example embodiments may include protocols such as wireless fidelity (Wi-Fi) (Institute of Electrical And Electronics Engineers (IEEE) 802.11 family, or the like), worldwide interoperability for microwave access (WiMAX) (IEEE 802.16 family, or the like), IEEE 802.20, long term evolution (LTE), evolution data only (Ev-DO), high speed packet access+(HSPA+), high speed downlink packet access+(HSDPA+), high speed uplink packet access+(HSUPA+), enhanced data GSM environment (EDGE), global system for mobile communications (GSM), global positioning system (GPS), general packet radio service (GPRS), code division multiple access (CDMA), time division multiple access (TDMA), digital enhanced cordless telecommunications (DECT), Bluetooth, 3G, 4G, and 5G protocols, and any other wireless and wired protocols designated after the above-mentioned protocols, but an example embodiment thereof is not limited thereto.

According to the aforementioned example embodiments, the antenna apparatus in the example embodiment may have improved antenna performances (e.g., a gain, a bandwidth, directivity, and the like), may provide a plurality of communications corresponding to a plurality of different bands, respectively, in an efficient manner, and may be easily miniaturized.

While specific examples have been shown and described above, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus, comprising:

a ground plane;

a plurality of first patch antenna patterns disposed on a level higher than the ground plane and each configured to transmit and/or receive a first radio frequency signal of a first frequency;

a plurality of second patch antenna patterns disposed on a level higher than the ground plane and each having a size smaller than a size of each of the plurality of first patch antenna patterns, wherein the plurality of second patch antenna patterns comprise a plurality of feed patch antenna patterns configured to transmit and/or receive a second radio frequency signal of a second frequency different from the first frequency, and a plurality of dummy patch antenna patterns, which are not fed any of the first and second radio frequency signals, and wherein one of the plurality of first patch antenna patterns and one of the plurality of dummy patch antenna patterns are alternately disposed when viewed from a top of the antenna apparatus.

2. The antenna apparatus of claim 1, wherein the plurality of second patch antenna patterns are disposed on a level higher than the plurality of first patch antenna patterns.

3. The antenna apparatus of claim 1, further comprising:

a plurality of third patch antenna patterns disposed on a level higher than the ground plane, overlapping the plurality of first patch antenna patterns, and each configured to transmit and/or receive a third radio frequency signal of a third frequency different from the first and second frequencies.

4. The antenna apparatus of claim 1, further comprising:

a plurality of third patch antenna patterns disposed on a level higher than the ground plane, overlapping the plurality of first patch antenna patterns, and each having a size less than a size of each of the plurality of first patch antenna patterns and greater than a size of each of the plurality of second patch antenna patterns.

5. The antenna apparatus of claim 1, further comprising:

a plurality of third patch antenna patterns disposed on a level higher than the ground plane, overlapping the plurality of first patch antenna patterns, and disposed on a level higher than the plurality of first patch antenna patterns and lower than the plurality of second patch antenna patterns.

6. The antenna apparatus of claim 1, wherein portions of the plurality of second patch antenna patterns overlap the plurality of first patch antenna patterns, and wherein other portions of the plurality of second patch antenna patterns do not overlap the plurality of first patch antenna patterns.

7. The antenna apparatus of claim 1, wherein the plurality of first patch antenna patterns are spaced apart from each other by a first spacing distance and are arranged in a first direction, and wherein the plurality of second patch antenna patterns are spaced apart from each other by a second spacing distance shorter than the first spacing distance and are arranged in the first direction.

8. The antenna apparatus of claim 1, wherein portions of the plurality of second patch antenna patterns are arranged in a first direction, and wherein the portions of the plurality of second patch antenna patterns are disposed such that each of the plurality of first patch antenna patterns is disposed in a region between the portions of the plurality of second patch antenna patterns taken in a second direction.

9. The antenna apparatus of claim 8, wherein other portions of the plurality of second patch antenna patterns are disposed such that each of the plurality of first patch antenna patterns is disposed in a region between the other portions of the plurality of second patch antenna patterns taken in the first direction.

10. The antenna apparatus of claim 8, further comprising:

a plurality of third patch antenna patterns disposed on a level higher than the ground plane, overlapping the plurality of first patch antenna patterns, and each configured to transmit and/or receive a third radio frequency signal of a third frequency different from the first and second frequencies.

11. The antenna apparatus of claim 1, wherein at least one of the plurality of second patch antenna patterns comprises at least one slit portion formed from one side to the other side, and overlaps a corresponding first patch antenna pattern of the plurality of first patch antenna patterns.

12. The antenna apparatus of claim 1, wherein at least one of the plurality of second patch antenna patterns overlaps a corresponding first patch antenna pattern of the plurality of first patch antenna patterns, and wherein the at least one of the plurality of second patch antenna patterns extends in a plurality of directions from one point overlapping the corresponding first patch antenna pattern.

13. The antenna apparatus of claim 1, further comprising:

a plurality of second feed vias providing a feed path for at least one feed patch antenna pattern of the plurality of second patch antenna patterns and penetrating the ground plane.

14. The antenna apparatus of claim 13, further comprising:

a plurality of first feed vias providing a feed path for a corresponding first patch antenna pattern of the plurality of first patch antenna patterns and penetrating the ground plane.

15. The antenna apparatus of claim 13, wherein at least one of the plurality of second feed vias provides a feed path for a corresponding first patch antenna pattern of the plurality of first patch antenna patterns.

16. An antenna apparatus, comprising:

a ground plane;

a plurality of first patch antenna patterns arranged on a level higher than the ground plane and fed with power; and a plurality of second patch antenna patterns each having a size smaller than a size of each of the plurality of first patch antenna patterns, and arranged on a level higher than the ground plane, wherein the plurality of second patch antenna patterns are arranged to surround each of the plurality of first patch antenna patterns and each of a plurality of regions between adjacent ones of the plurality of first patch antenna patterns, and wherein each of the plurality of regions between adjacent ones of the plurality of first patch antenna patterns is surrounded in first and second directions.

17. The antenna apparatus of claim 16, wherein each second patch antenna pattern of the portion of the plurality of second patch antenna patterns has a structure in which a length taken in the first direction is longer than a length taken in the second direction, and each second patch antenna pattern of another portion of the plurality of second patch antenna patterns has a structure in which a length taken in the first direction is shorter than a length taken in the second direction.

18. The antenna apparatus of claim 16, wherein the plurality of first patch antenna patterns are arranged in the first direction, and wherein a length of each of the plurality of regions surrounded by the portions of the plurality of second patch antenna patterns taken in the second direction is longer than a length of each of the plurality of regions taken in the first direction.

19. The antenna apparatus of claim 16, wherein the plurality of second patch antenna patterns are disposed on a level higher than the plurality of first patch antenna patterns.

20. The antenna apparatus of claim 16, further comprising a plurality of third patch antenna patterns disposed on a level higher than the ground plane, overlapping the plurality of first patch antenna patterns, and fed with power.

21. An antenna apparatus, comprising:

a ground plane;

a plurality of first patch antenna patterns arranged on a level higher than the ground plane and each configured to transmit and/or receive a first radio frequency signal of a first frequency;

a plurality of second patch antenna patterns arranged on a level higher than the ground plane and each having a size smaller than a size of each of the plurality of first patch antenna patterns;

a plurality of third patch antenna patterns disposed on a level higher than the ground plane, overlapping the plurality of first patch antenna patterns, and disposed on a level higher than the plurality of first patch antenna patterns and lower than the plurality of second patch antenna patterns, wherein the plurality of second patch antenna patterns include at least one feed patch antenna pattern configured to transmit and/or receive a second radio frequency signal of a second frequency different from the first frequency, and at least one dummy patch antenna pattern which is not fed any of the first and second radio frequency signals.

* * * * *